US012589845B2

(12) United States Patent
Amma et al.

(10) Patent No.: US 12,589,845 B2
(45) Date of Patent: Mar. 31, 2026

(54) VESSEL OPERATOR WARNING SUPPORT SYSTEM AND VESSEL OPERATOR WARNING SUPPORT METHOD

(71) Applicant: YAMAHA HATSUDOKI KABUSHIKI KAISHA, Iwata (JP)

(72) Inventors: Hirofumi Amma, Shizuoka (JP); Hidenori Satake, Shizuoka (JP); Yukitaka Okamoto, Shizuoka (JP); Hideyoshi Sato, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 30 days.

(21) Appl. No.: 18/882,885

(22) Filed: Sep. 12, 2024

(65) Prior Publication Data

US 2025/0002127 A1 Jan. 2, 2025

Related U.S. Application Data

(63) Continuation of application No. PCT/JP2023/004871, filed on Feb. 14, 2023.

(30) Foreign Application Priority Data

Mar. 16, 2022 (JP) ..... 2022-041295

(51) Int. Cl.
*B63B 79/30* (2020.01)
*B63B 79/40* (2020.01)
(Continued)

(52) U.S. Cl.
CPC ..... *B63B 79/40* (2020.01); *B63H 21/21* (2013.01); *B63B 34/10* (2020.02); *B63H 2021/216* (2013.01)

(58) Field of Classification Search
CPC ..... B63B 79/40; B63B 34/10; B63B 49/00; B63H 21/21; B63H 2021/216; G08G 3/02
See application file for complete search history.

(56) References Cited

U.S. PATENT DOCUMENTS 6,750,815 B2 * 6/2004 Michaelson ..... G01C 21/22 367/909
9,927,520 B1 * 3/2018 Ward ..... G01S 15/93
(Continued)

FOREIGN PATENT DOCUMENTS

CN 111986517 A 11/2020
JP H0329995 U 3/1991
(Continued)

OTHER PUBLICATIONS

International Search Report in PCT/JP2023/004871, mailed Apr. 25, 2023, 3 pages.

*Primary Examiner* — Richard M Camby
(74) *Attorney, Agent, or Firm* — Keating & Bennett, LLP

(57) ABSTRACT

A vessel operator warning support system includes a personal watercraft (PWC), an information terminal operable to acquire current position information on the PWC and to communicate with the PWC, and a controller configured or programmed to perform a predetermined control based on an engine speed. The information terminal is operable to acquire a navigation speed of the PWC based on the position information, a warning generator is configured or programmed to issue a predetermined warning when the navigation speed exceeds a speed limit in a speed restricted area in which the navigation speed is restricted, and the controller is configured or programmed to disable the warning such that the warning is not issued when the engine speed is equal to or lower than a threshold rotation speed even when the navigation speed exceeds the speed limit.

30 Claims, 9 Drawing Sheets

(51) Int. Cl.
*B63H 21/21* (2006.01)
*B63B 34/10* (2020.01)

(56) References Cited

U.S. PATENT DOCUMENTS

| | | | | |
|---|---|---|---|---|
| 11,535,348 | B2 * | 12/2022 | Hashizume | B63H 21/22 |
| 2013/0102206 | A1 * | 4/2013 | Fujino | B63H 25/04 440/1 |
| 2013/0252490 | A1 | 9/2013 | Kinoshita | |
| 2018/0004209 | A1 * | 1/2018 | Akuzawa | G05D 1/0206 |
| 2018/0348007 | A1 | 12/2018 | Adachi | |
| 2019/0291832 | A1 | 9/2019 | Hashizume et al. | |
| 2020/0026293 | A1 | 1/2020 | Hashizume et al. | |
| 2021/0278846 | A1 * | 9/2021 | Nickols | B63H 21/21 |
| 2022/0281578 | A1 | 9/2022 | Morie et al. | |

FOREIGN PATENT DOCUMENTS

| | | | |
|---|---|---|---|
| JP | 3068588 | B1 | 7/2000 |
| JP | 2004218583 | A | 8/2004 |
| JP | 2005280425 | A | 10/2005 |
| JP | 4361242 | B2 | 11/2009 |
| JP | 4965377 | B2 | 7/2012 |
| JP | 2013086668 | A | 5/2013 |
| JP | 2013199212 | A | 10/2013 |
| JP | 2015085902 | A | 5/2015 |
| JP | 5964878 | B2 | 8/2016 |
| JP | 6466600 | B1 | 2/2019 |
| JP | 2022134608 | A | 9/2022 |
| WO | 2017138127 | A1 | 8/2017 |
| WO | 2018179443 | A1 | 10/2018 |

* cited by examiner

VESSEL OPERATOR WARNING SUPPORT SYSTEM AND VESSEL OPERATOR WARNING SUPPORT METHOD

CROSS REFERENCE TO RELATED APPLICATIONS

This application is a Continuation Application of PCT Application No. PCT/JP2023/004871 filed on Feb. 14, 2023, which claims the benefit of priority to Japanese Patent Application No. 2022-041295 filed on Mar. 16, 2022. The entire contents of each application are hereby incorporated herein by reference.

BACKGROUND OF THE INVENTION

1. Field of the Invention

The present invention relates to vessel operator warning support systems and vessel operator warning support methods.

2. Description of the Related Art

A marine vessel that acquires its navigation speed based on its position information is known in general. Such a marine vessel is disclosed in Japanese Patent No. 6466600, for example.

Japanese Patent No. 6466600 discloses a marine vessel that acquires its navigation speed based on position information acquired by a global positioning system (GPS) receiver. When the marine vessel enters a speed restricted area and exceeds a speed limit, the marine vessel issues a predetermined warning and decreases its navigation speed to the speed limit or lower.

SUMMARY OF THE INVENTION

The marine vessel described in Japanese Patent No. 6466600 acquires its navigation speed based on the position information acquired by the GPS receiver, and thus even when the marine vessel is maneuvered to clearly decrease a propulsive force so as to not exceed the speed limit, the navigation speed may increase when external forces including wind and waves act on a hull. In such a case, a warning may be issued for exceeding the speed limit, and improvement is required.

Example embodiments of the present invention provide vessel operator warning support systems and vessel operator warning support methods that each reduce or prevent the possibility that warnings are issued when navigation speeds exceed speed limits when external forces including wind and waves act on hulls such that the navigation speeds increase.

According to an example embodiment of the present invention, a vessel operator warning support system includes a marine vessel including an engine and a communicator, a warning generator configured or programmed to acquire current position information on the marine vessel and to communicate with the communicator of the marine vessel, and a controller configured or programmed to perform a predetermined control based on an engine speed. The warning generator is configured or programmed to acquire a navigation speed of the marine vessel based on the position information, and to issue a predetermined warning when the navigation speed exceeds a speed limit in a location alert area including a speed restricted area in which the navigation speed is restricted, and the controller is configured or programmed to perform a control to disable the warning such that the warning is not issued when the engine speed is equal to or lower than a threshold rotation speed even when the navigation speed exceeds the speed limit.

As described above, the vessel operator warning support system includes the controller configured or programmed to perform a control to disable the warning such that the warning is not issued when the engine speed is equal to or lower than the threshold rotation speed even when the navigation speed exceeds the speed limit. Accordingly, it is determined whether or not the warning is issued by taking into consideration not only the navigation speed based on the position information, which is affected by external forces including wind and waves, but also the engine speed, which is not affected by external forces including wind and waves. Therefore, even when the navigation speed exceeds the speed limit, the warning is not issued when the marine vessel is being operated at an engine speed at which the propulsive force is relatively small, such as at which the propulsive force becomes substantially zero. Therefore, when external forces including wind and waves act on a hull such that the navigation speed increases, the possibility that the warning is issued that the navigation speed exceeds the speed limit is reduced or prevented.

In the vessel operator warning support system according to an example embodiment, the threshold rotation speed is preferably set to a value at which the navigation speed is equal to or lower than the speed limit when the engine speed is equal to or lower than the threshold rotation speed in a state in which external forces including wind and waves are not acting. Accordingly, when the marine vessel is being operated under action of external forces including wind and waves at an engine speed that maintains the navigation speed at or below the speed limit in a state in which external forces including wind and waves are not acting, the possibility that the warning is issued that the navigation speed exceeds the speed limit is more reliably reduced or prevented.

In the vessel operator warning support system according to an example embodiment, the marine vessel is preferably operable to navigate by specifying the engine speed, and the controller is preferably configured or programmed to disable the warning when a specified engine speed is equal to or lower than the threshold rotation speed. Accordingly, the engine speed is specified, and thus the engine speed is specified to be the threshold rotation speed such that the possibility that the warning is issued that the navigation speed exceeds the speed limit is more reliably reduced or prevented.

In such a case, the marine vessel is preferably operable to switch from a state in which the navigation speed is changed by an accelerator to a low rotation speed maintenance mode in which the engine speed is maintained at a predetermined engine speed equal to or lower than the threshold rotation speed, and the controller is preferably configured or programmed to disable the warning such that the warning is not issued when the marine vessel switches to the low rotation speed maintenance mode even when the navigation speed exceeds the speed limit. Accordingly, even when the navigation speed exceeds the speed limit, the warning is easily and reliably disabled when the low rotation speed maintenance mode is selected.

In the structure in which the marine vessel is operable to navigate by specifying the engine speed, the marine vessel preferably includes a rotation speed specification operator to specify the engine speed by increasing or decreasing the engine speed, and is preferably operable to switch from a state in which the navigation speed is changed by an accelerator to a cruise control mode in which the engine speed is specified by the rotation speed specification operator, and the controller is preferably configured or programmed to disable the warning such that the warning is not issued when the engine speed is specified to be a value equal to or lower than the threshold rotation speed by the rotation speed specification operator in the cruise control mode even when the navigation speed exceeds the speed limit. Accordingly, the warning is disabled simply by switching to the cruise control mode and specifying the engine speed to be a value equal to or lower than the threshold rotation speed using the rotation speed specification operator, and thus it is easy to disable the warning.

In the vessel operator warning support system according to an example embodiment, the warning generator is preferably configured or programmed to acquire the current position information from a positioning satellite. Accordingly, the warning generator acquires the current position information from the positioning satellite, and thus the navigation speed is easily acquired.

In the vessel operator warning support system according to an example embodiment, the controller is preferably configured or programmed to disable the warning such that the warning is not issued regardless of the engine speed when the marine vessel is in a reverse movement state. Accordingly, in the reverse movement state in which the navigation speed is restricted to a relatively low speed, the overspeed warning is not issued.

In the vessel operator warning support system according to an example embodiment, the warning generator preferably includes a display, and is configured or programmed to, when the navigation speed exceeds the speed limit in the speed restricted area, issue the warning by displaying a warning image on the display, and the controller is preferably configured or programmed to disable the warning such that the warning image is not displayed on the display when the engine speed is equal to or lower than the threshold rotation speed. Accordingly, the warning is disabled such that the warning image, which is a visual warning to be issued for a vessel operator, is not displayed on the display.

The vessel operator warning support system according to an example embodiment preferably further includes a speaker on the marine vessel to output a warning sound as the warning, the warning generator is preferably operable to issue the warning by outputting the warning sound from the speaker when the navigation speed exceeds the speed limit in the speed restricted area, and the controller is preferably configured or programmed to disable the warning such that the warning sound is not output from the speaker when the engine speed is equal to or lower than the threshold rotation speed. Accordingly, the warning is disabled such that the warning sound, which is an auditory warning to be issued for the vessel operator, is not output from the speaker.

In such a case, the controller is preferably configured or programmed to perform a control to decrease a warning sound volume when a first period of time has elapsed from a start of output of the warning sound. Accordingly, the warning sound is prevented from continuing to be output at a relatively loud volume at the start of output. Consequently, the warning sound is output at a volume that takes the surrounding environment into consideration. Furthermore, the warning sound volume is decreased during output of the warning sound, and thus the warning sound is decreased after the vessel operator is made aware that the warning sound is being output.

In the structure in which the warning sound volume is decreased when the first period of time has elapsed, the controller is preferably configured or programmed to decrease the warning sound volume to half or less of a volume at the start of output of the warning sound when the first period of time has elapsed from the start of output of the warning sound. Accordingly, the warning sound becomes relatively small, and thus the warning sound is output at a volume that takes the surrounding environment into consideration.

In the structure in which the warning sound volume is decreased when the first period of time has elapsed, the controller is preferably configured or programmed to gradually decrease the warning sound volume over a second period of time that is shorter than the first period of time when the first period of time has elapsed from the start of output of the warning sound. Accordingly, the warning sound volume is gradually decreased over the second period of time, which is a relatively short period of time, and thus as compared with a case in which the warning sound volume is instantaneously decreased, the vessel operator is more reliably made aware that the warning sound continues to be output even when the volume has been decreased.

In the structure in which the warning sound volume is decreased when the first period of time has elapsed, the location alert area preferably includes an entry prohibited area in which entry of the marine vessel is prohibited, the warning generator is preferably configured or programmed to issue the warning by outputting the warning sound from the speaker not only when the navigation speed exceeds the speed limit in the speed restricted area but also when the marine vessel enters the entry prohibited area, and the controller is preferably configured or programmed to decrease the warning sound volume when the first period of time has elapsed from the start of output of the warning sound that is at a time point at which the marine vessel enters the entry prohibited area. Accordingly, not only the warning sound for overspeed, but also the warning sound output when the marine vessel enters the entry prohibited area is decreased in volume after the vessel operator is made aware that the warning sound is being output.

The vessel operator warning support system according to an example embodiment preferably further includes a speaker on the marine vessel to output a warning sound as the warning and an audio sound including music, and the controller is preferably configured or programmed to perform at least one of a control to decrease an audio sound volume or a control to notify a vessel operator that the audio sound volume is equal to or greater than a threshold sound volume when the audio sound volume is equal to or greater than the threshold sound volume when the marine vessel enters an audio restricted area in which the audio sound volume is restricted. Accordingly, when the audio sound volume is equal to or greater than the threshold sound volume (when the volume is relatively loud) when the marine vessel enters the audio restricted area, the audio sound volume is automatically decreased and/or the vessel operator is made aware that the audio sound volume is relatively loud. Therefore, the possibility that the audio sound continues to be output at a relatively loud volume is reduced or prevented. Consequently, the audio sound is output at a volume that takes the surrounding environment into consideration.

In such a case, the controller is preferably configured or programmed to decrease the audio sound volume to the threshold sound volume or less when the audio sound volume is greater than the threshold sound volume when the marine vessel enters the audio restricted area. Accordingly, the audio sound becomes relatively small, and thus the audio sound is output at a volume that takes the surrounding environment into consideration.

In the vessel operator warning support system according to an example embodiment, the warning generator is preferably configured or programmed to acquire the current position information from a positioning satellite, and the controller is preferably configured or programmed to perform a control to correct a current position of the marine vessel indicated by the current position information to become closer to a previous position of the marine vessel indicated by previous position information, and set a corrected current position when a distance between the current position and the previous position is equal to or greater than a threshold distance. Accordingly, when the distance between the current position and the previous position of the marine vessel is equal to or larger than the threshold distance, the current position is corrected to become closer to the previous position such that the corrected current position is set. Thus, a significant deviation of the current position of the marine vessel from the previous position is reduced or prevented. Therefore, more accurate position information is acquired, and thus the navigation speed is acquired more accurately based on the position information. Consequently, the possibility that the navigation speed is erroneously determined to exceed the speed limit due to inaccurate position information such that an overspeed warning is erroneously issued is reduced or prevented, for example.

In such a case, the controller is preferably configured or programmed to set a separation distance from the previous position to the corrected current position based on the navigation speed of the marine vessel at the previous position. Accordingly, the separation distance is set based on the navigation speed, and thus the corrected current position is set easily and accurately.

In the structure in which the separation distance from the previous position to the corrected current position is set based on the navigation speed of the marine vessel, the marine vessel preferably includes a rotation speed detector to detect the engine speed, and the controller is preferably configured or programmed to acquire the navigation speed used to set the separation distance based on a detection result of the rotation speed detector. Accordingly, the navigation speed is acquired based on the engine speed, rather than on position information with uncertain accuracy in which the marine vessel is highly likely to be positionally deviated, and thus the corrected current position is set more accurately.

In the structure in which the corrected current position is set, the controller is preferably configured or programmed to set the corrected current position on a straight line connecting the current position to the previous position. Accordingly, the corrected current position is set on the straight line connecting the current position to the previous position, and thus it is easy to set the corrected current position.

In the vessel operator warning support system according to the first aspect, the warning generator is preferably configured or programmed to automatically set, in a near-shoreline area within a predetermined distance from a shoreline, a target navigation route that linearly extends in a direction away from the shoreline such that a navigation distance of the marine vessel in the near-shoreline area is decreased when the marine vessel is located in the location alert area including the near-shoreline area, and to not issue the predetermined warning when the marine vessel moves along the target navigation route. Accordingly, the target navigation route is automatically set in the near-shoreline area, and the vessel operator recognizes that the marine vessel is moving along the target navigation route due to the absence of the predetermined warning. Therefore, when the marine vessel passes through the near-shoreline area to dock or undock, the vessel operator easily recognizes whether or not the marine vessel is moving along an appropriate route.

In such a case, the controller is preferably configured or programmed to issue the warning when the marine vessel deviates from the target navigation route. Accordingly, the warning is issued when the marine vessel deviates from the target navigation route, and thus the vessel operator is more reliably made aware that the marine vessel has deviated from the target navigation route.

In the structure in which the target navigation route is automatically set, the controller is preferably configured or programmed to create a shoreline model that is smoothed to reduce irregularities of the shoreline, and to automatically set, in the near-shoreline area, the target navigation route that linearly extends in a direction away from the shoreline model such that the navigation distance of the marine vessel in the near-shoreline area is minimized. Accordingly, the possibility that an inaccurate target navigation route is set, such as that the target navigation route is set toward a convex portion of the shoreline having relatively large irregularities when the vessel operator wants to head toward a concave portion of the shoreline, is reduced or prevented.

In the vessel operator warning support system according to an example embodiment, the warning generator is preferably configured or programmed to transmit image information and sound information of the warning generator to a wearable terminal worn by a vessel operator. Accordingly, the vessel operator is able to easily check the image information and the sound information of the warning generator using the wearable terminal.

In the vessel operator warning support system according to an example embodiment, the warning generator preferably includes a display to display a water area map showing a current position of the marine vessel and the location alert area, is preferably configured or programmed to communicate with a cloud server operable to hold map information used to display the water area map on the display, and to acquire the map information from the cloud server. Accordingly, the map information used to display the water area map on the display of the warning generator is easily acquired from the cloud server.

A vessel operator warning support method according to another example embodiment of the present invention includes acquiring a navigation speed of a marine vessel based on current position information and determining whether or not the navigation speed exceeds a speed limit in a location alert area including a speed restricted area in which the navigation speed is restricted using a warning generator, issuing a predetermined warning when the navigation speed exceeds the speed limit in the speed restricted area using the warning generator, determining whether or not an engine speed is equal to or lower than a threshold rotation speed, and disabling the warning such that the warning is not issued when the engine speed is equal to or lower than the threshold rotation speed even when the navigation speed exceeds the speed limit.

As described above, the vessel operator warning support method according to an example embodiment of the present invention includes disabling the warning such that the warning is not issued when the engine speed is equal to or lower than the threshold rotation speed even when the navigation speed exceeds the speed limit. Accordingly, it is determined whether or not the warning is issued by taking into consideration not only the navigation speed based on the position information, which is affected by external forces including wind and waves, but also the engine speed, which is not affected by external forces including wind and waves. Therefore, even when the navigation speed exceeds the speed limit, the warning is not issued when the marine vessel is being operated at an engine speed at which the propulsive force is relatively small, such as at which the propulsive force becomes substantially zero. Therefore, when external forces including wind and waves act on a hull such that the navigation speed increases, the possibility that the warning is issued when the navigation speed exceeds the speed limit is reduced or prevented.

In the vessel operator warning support method according to an example embodiment, the issuing of the warning preferably includes issuing the warning by outputting a warning sound from a speaker on the marine vessel when the navigation speed exceeds the speed limit in the speed restricted area, and the disabling of the warning preferably includes disabling the warning such that the warning sound is not output from the speaker when the engine speed is equal to or lower than the threshold rotation speed. Accordingly, the warning is disabled such that the warning sound, which is an auditory warning to be issued for a vessel operator, is not output from the speaker.

In such a case, the issuing of the warning preferably includes turning the warning sound down when a first period of time has elapsed from a start of output of the warning sound from the speaker. Accordingly, the warning sound is prevented from continuing to be output at a relatively loud volume at the start of output. Consequently, the warning sound is output at a volume that takes the surrounding environment into consideration. Furthermore, the warning sound volume is decreased during output of the warning sound, and thus the warning sound is decreased after the vessel operator is made aware that the warning sound is being output.

The vessel operator warning support method according to an example embodiment preferably further includes determining whether or not an audio sound volume is equal to or greater than a threshold sound volume when the marine vessel enters an audio restricted area in which the audio sound volume including music output from a speaker is restricted, and decreasing the audio sound volume and/or notifying a user that the audio sound volume is equal to or greater than the threshold sound volume when the audio sound volume is equal to or greater than the threshold sound volume. Accordingly, when the audio sound volume is equal to or greater than the threshold sound volume (when the volume is relatively loud) when the marine vessel enters the audio restricted area, the audio sound volume is automatically decreased and/or the vessel operator is made aware that the audio sound volume is relatively loud. Therefore, the possibility that the audio sound continues to be output at a relatively loud volume is reduced or prevented. Consequently, the audio sound is output at a volume that takes the surrounding environment into consideration.

The vessel operator warning support method according to an example embodiment preferably further includes acquiring the current position information on the marine vessel from a positioning satellite using the warning generator, determining whether or not a distance between a current position of the marine vessel indicated by the current position information and a previous position of the marine vessel indicated by previous position information is equal to or larger than a threshold distance, and correcting the current position to become closer to the previous position and setting a corrected current position when the distance between the current position and the previous position is equal to or larger than the threshold distance. Accordingly, when the distance between the current position and the previous position of the marine vessel is equal to or larger than the threshold distance, the current position is corrected to become closer to the previous position such that the corrected current position is set. Thus, a significant deviation of the current position of the marine vessel from the previous position is reduced or prevented. Therefore, more accurate position information is acquired, and thus the navigation speed is acquired more accurately based on the position information. Consequently, the possibility that the navigation speed is erroneously determined to exceed the speed limit due to inaccurate position information such that an overspeed warning is erroneously issued is reduced or prevented, for example.

The vessel operator warning support method according to an example embodiment preferably further includes determining whether or not the marine vessel is located in the location alert area including a near-shoreline area within a predetermined distance from a shoreline, automatically setting, in the near-shoreline area, a target navigation route that linearly extends in a direction away from the shoreline such that a navigation distance of the marine vessel in the near-shoreline area is decreased when the marine vessel is located in the near-shoreline area, and not issuing the predetermined warning when the marine vessel moves along the target navigation route. Accordingly, the target navigation route is automatically set in the near-shoreline area, and the vessel operator recognizes that the marine vessel is moving along the target navigation route due to the absence of the predetermined warning. Therefore, when the marine vessel passes through the near-shoreline area to dock or undock, the vessel operator easily recognizes whether or not the marine vessel is moving along an appropriate route.

In addition, an example embodiment of the present invention may also conceivably include a vessel operator warning support system including a marine vessel including an engine and a communicator, a warning generator configured or programmed to communicate with the communicator of the marine vessel, a speaker on the marine vessel, and a controller configured or programmed to perform a control to decrease a sound volume of the speaker, wherein the warning generator is configured or programmed to output a warning sound from the speaker when a navigation speed of the marine vessel exceeds a speed limit in a speed restricted area in which the navigation speed of the marine vessel is restricted and/or the marine vessel enters an entry prohibited area, and the controller is configured or programmed to perform a control to decrease a warning sound volume when a predetermined period of time has elapsed from a start of output of the warning sound. Accordingly, the warning sound is prevented from continuing to be output at a relatively loud volume at the start of output. Consequently, the warning sound is output at a volume that takes the surrounding environment into consideration. Furthermore, the warning sound volume is decreased during output of the warning sound, and thus the warning sound is decreased after a vessel operator is made aware that the warning sound is being output.

An example embodiment of the present invention may also conceivably include a vessel operator warning support system including a marine vessel including an engine and a communicator, a warning generator configured or programmed to communicate with the communicator of the marine vessel, a speaker on the marine vessel, and a controller configured or programmed to perform a control to decrease a sound volume of the speaker, wherein the warning generator is configured or programmed to output a warning sound from the speaker when a navigation speed of the marine vessel exceeds a speed limit in a speed restricted area in which the navigation speed of the marine vessel is restricted and/or the marine vessel enters an entry prohibited area, the speaker is operable to output an audio sound including music in addition to the warning sound, and the controller is configured or programmed to perform at least one of a control to decrease an audio sound volume or a control to notify a vessel operator that the audio sound volume is greater than a threshold sound volume when the audio sound volume is greater than the threshold sound volume when the marine vessel enters an audio restricted area in which the audio sound volume is restricted. Accordingly, when the audio sound volume is equal to or greater than the threshold sound volume (when the volume is relatively loud) when the small marine vessel enters the audio restricted area, the audio sound volume is automatically decreased and/or the vessel operator is made aware that the audio sound volume is relatively loud. Therefore, the possibility that the audio sound continues to be output at a relatively loud volume is reduced or prevented. Consequently, the audio sound is output at a volume that takes the surrounding environment into consideration.

According to example embodiments of the present invention, as described above, the vessel operator warning support systems and the vessel operator warning support methods are provided that each reduce or prevent the possibility that the warnings are issued that the navigation speeds exceed the speed limits when external forces including wind and waves act on the hulls such that the navigation speeds increase.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention are hereinafter described with reference to the drawings.

The structure of a vessel operator warning support system 100 is now described with reference to FIGS. 1 to 15.

Figure 1:
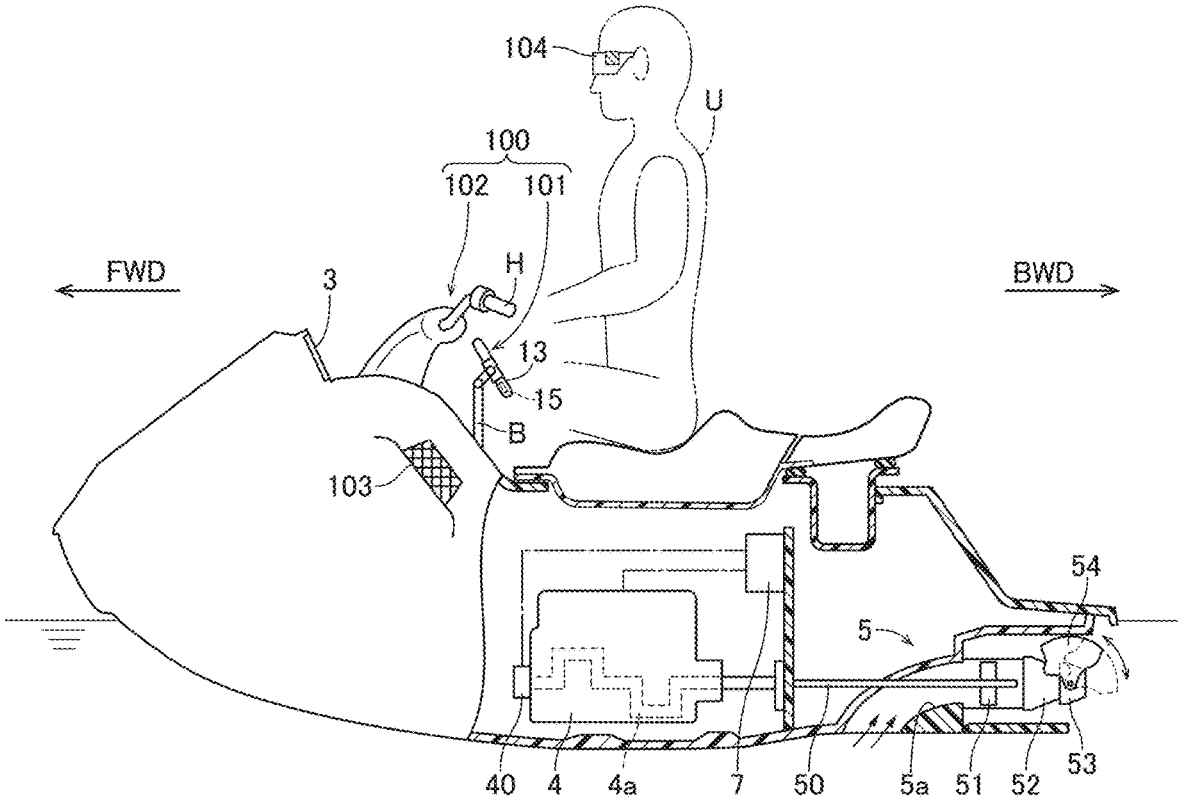
FIG. 1 is a side view showing a personal watercraft and an information terminal of a vessel operator warning support system according to an example embodiment of the present invention.
Figure 2:
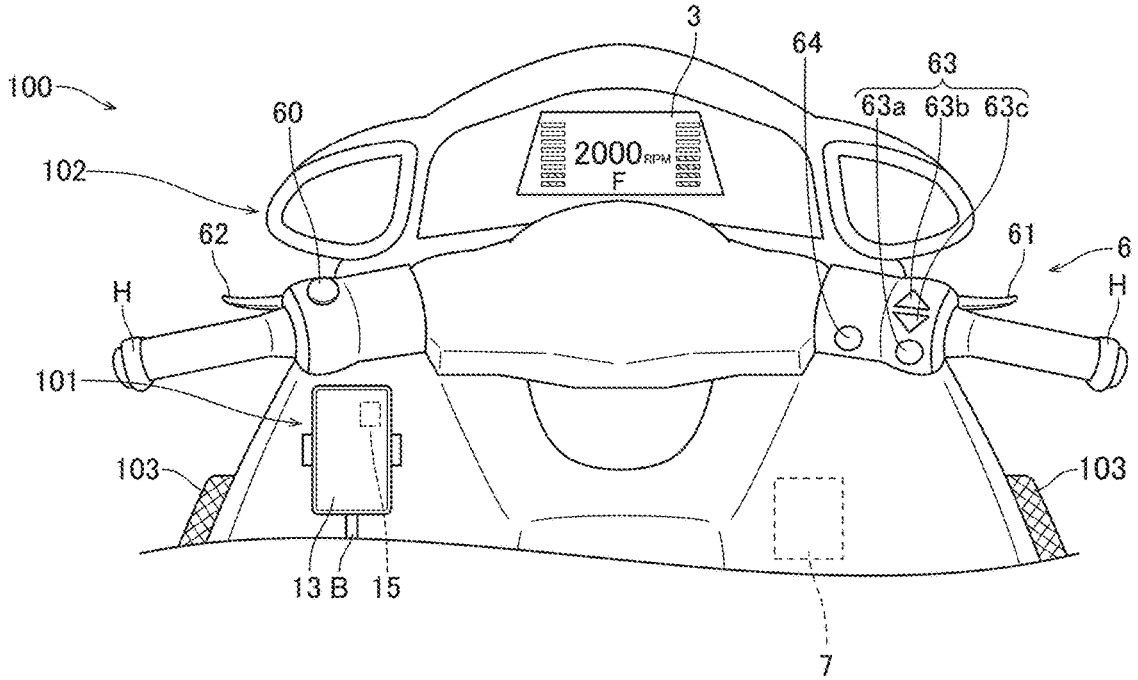
FIG. 2 is a rear view of a portion of a personal watercraft and an information terminal of a vessel operator warning support system according to an example embodiment of the present invention.
Figure 3:
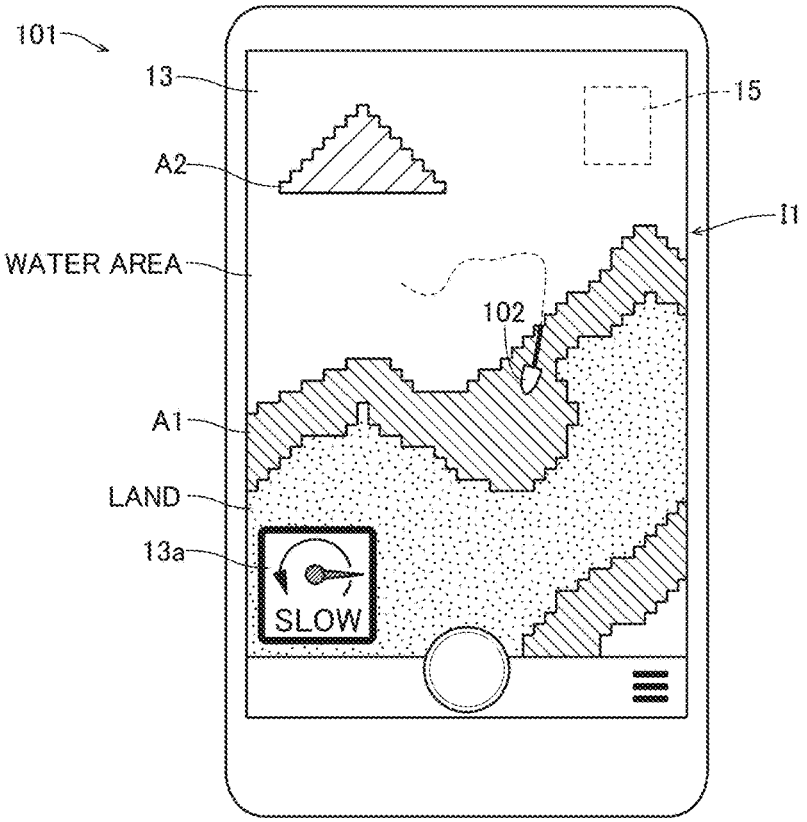
FIG. 3 is a diagram showing a warning screen on a display of an information terminal according to an example embodiment of the present invention when a personal watercraft exceeds a speed limit.
Figure 4:
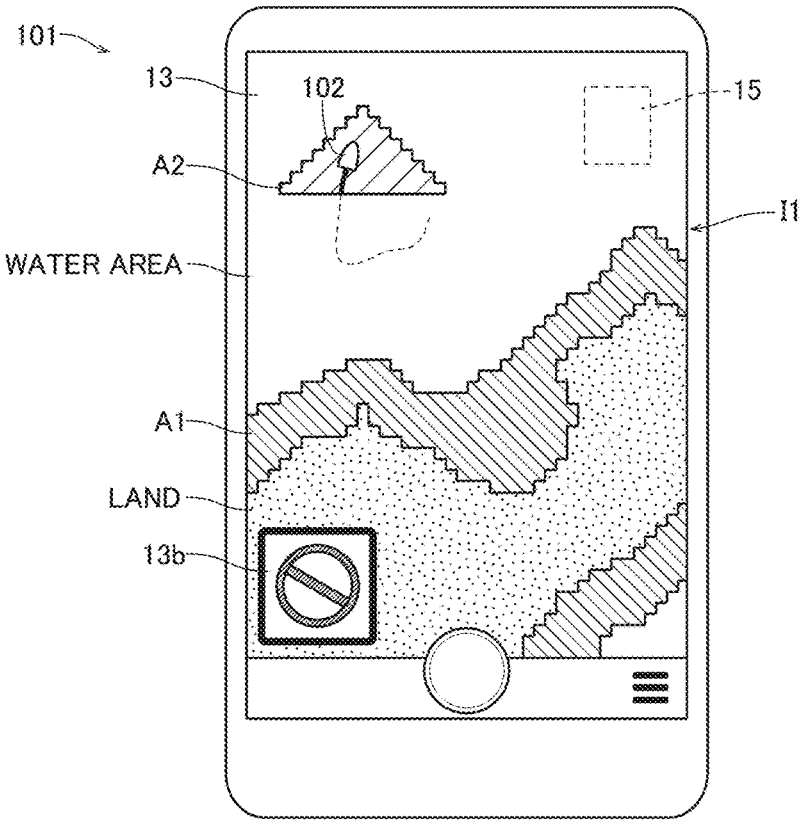
FIG. 4 is a diagram showing a warning screen on a display of an information terminal according to an example embodiment of the present invention when a personal watercraft enters an entry prohibited area.

As shown in FIGS. 1 and 2, the vessel operator warning support system 100 includes an information terminal 101 and a personal watercraft 102 (hereinafter referred to as a PWC). The PWC 102 includes a speaker 103 to output a warning sound for a predetermined warning and an audio sound including music, for example. The information terminal 101 is an example of a "warning generator". The PWC 102 is an example of a "marine vessel".

In FIG. 1, the forward movement direction of the PWC 102 is indicated by arrow FWD, and the reverse movement direction of the PWC 102 is indicated by arrow BWD.

A warning application I1 is installed on the information terminal 101, which issues a predetermined warning when the navigation speed of the PWC 102 exceeds a speed limit in a speed restricted area A1 (see FIG. 3) in which the navigation speed of the PWC 102 is restricted, or when the PWC 102 enters an entry prohibited area A2 (see FIG. 4) in which the entry of the PWC 102 is prohibited, for example. The speed restricted area A1 and the entry prohibited area A2 are examples of a "location alert area".

As an example, the information terminal 101 may be a smartphone or a tablet terminal. The information terminal 101 is attached to the PWC 102 by a bracket B. The bracket B is located in front of a seat on which a vessel operator U sits.

Figure 5:
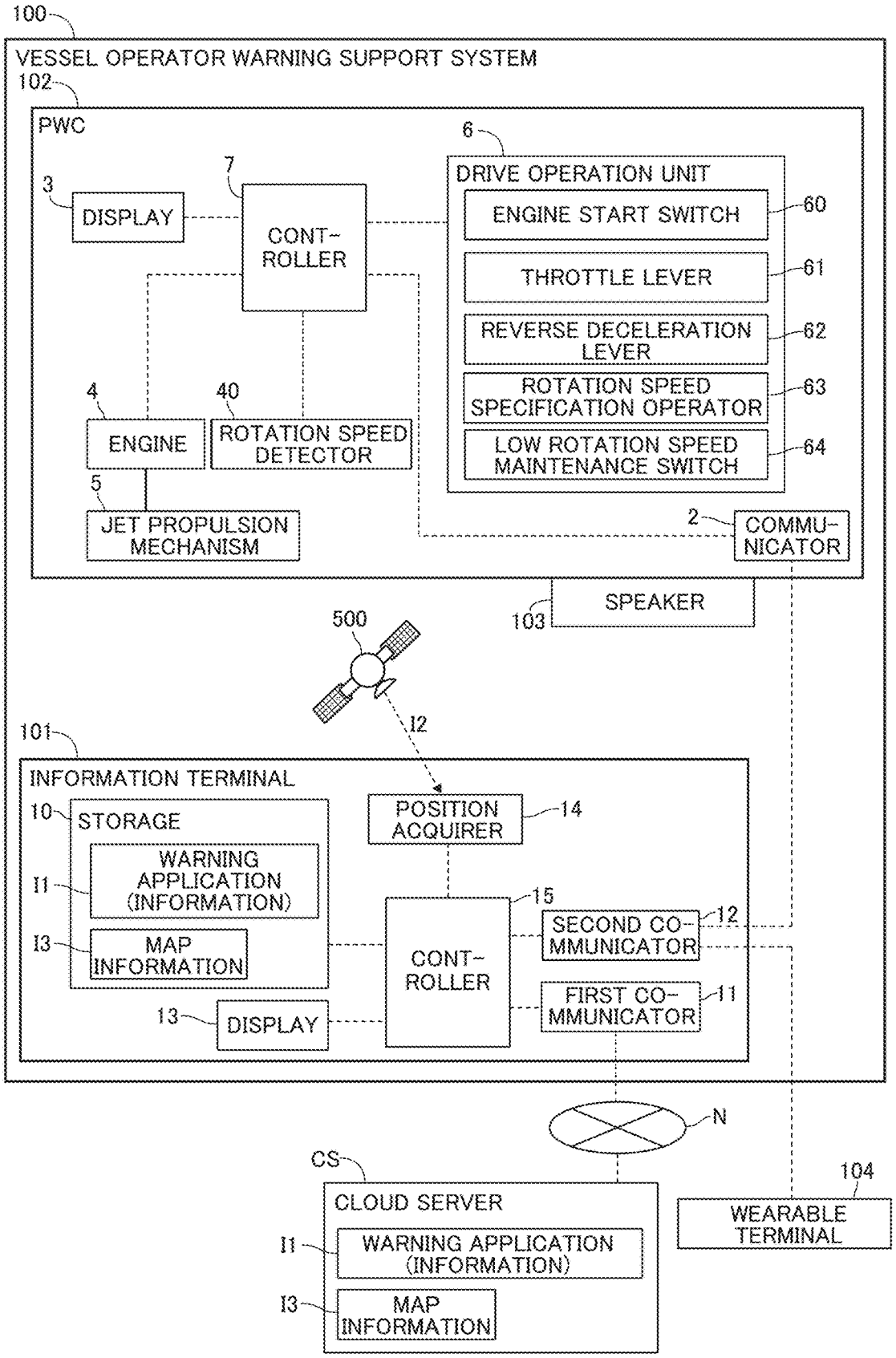
FIG. 5 is a block diagram of a personal watercraft and an information terminal of a vessel operator warning support system according to an example embodiment of the present invention.

As shown in FIG. 5, the information terminal 101 includes a storage 10, a first communicator 11 connectable to the Internet N, a second communicator 12 communicable with a communicator 2 of the PWC 102, a display 13, a position acquirer 14 to acquire position information 12, and a controller 15. The storage 10 stores various information such as the warning application I1. In FIG. 5, an example is shown in which the storage 10 is separate from the controller 15, but the controller may include the storage.

The first communicator 11 includes an Internet communication antenna connectable to the Internet N, and a transmitter/receiver to process transmitted and received information. As an example, the first communicator 11 is connectable to the Internet N using a communication standard such as Wi-Fi (registered trademark).

The information terminal 101 is communicable with a cloud server CS connected to the Internet N via the first communicator 11. The information terminal 101 is operable to acquire various information such as map information I3 from the cloud server CS via the first communicator 11. The cloud server CS holds various information such as the map information I3, the warning application I1 (information), and update information of the warning application. The map information I3 is used to display a water area map I10 on the display 13 of the information terminal 101. The water area map I10 shows a sea area in which the PWC 102 navigates, a land, and a structure such as a bridge, as well as the current position of the PWC 102, the speed restricted area A1, and the entry prohibited area A2, for example. The map information I3 is contained in the warning application I1, but may be separate from the warning application.

The second communicator 12 includes a communication antenna communicable with the PWC 102, and a transmitter/receiver to process transmitted and received information. As an example, the second communicator 12 is communicable with the communicator 2 of the PWC 102 using a communication standard such as Bluetooth (registered trademark).

The second communicator 12 is operable to transmit sound information such as a warning sound and an audio sound to the PWC 102. The warning sound, the audio sound, etc. are output from a speaker 103 provided on the PWC 102. The second communicator 12 may be directly communicable with the speaker 103 without going through the information terminal 101.

The audio sound is a sound produced when music information, etc. stored in the storage 10 of the information terminal 101 is output from the speaker 103. Therefore, the information terminal 101 is operable to change the audio sound volume output from the speaker 103. The audio sound may be a sound produced when music information, etc. stored in the PWC 102 is output from the speaker 103. In such a case as well, the information terminal 101 is able to change the audio sound volume output from the speaker 103.

The second communicator 12 is communicable with a wearable terminal 104 worn by the vessel operator U. The information terminal 101 is operable to transmit image information and sound information of the information terminal 101 to the wearable terminal 104 worn by the vessel operator U. As an example, the wearable terminal 104 is a head-mounted display worn on the head of the vessel operator U like glasses.

As an example, the display 13 is a touch panel liquid crystal display. The information terminal 101 displays the water area map I10 on the display 13 in the running warning application I1.

The information terminal 101 issues a warning by displaying a warning image 13*a* (warning icon) on the display 13 when the navigation speed of the PWC 102 exceeds the speed limit in the speed restricted area A1 in the running warning application I1.

Furthermore, the information terminal 101 issues a warning by outputting a warning sound from the speaker 103 when the navigation speed of the PWC 102 exceeds the speed limit in the speed restricted area A1 in the running warning application I1. The warning sound is continued until the PWC 102 leaves the speed restricted area A1 or the navigation speed becomes equal to or lower than the speed limit. In other words, the warning sound is continued until the overspeed situation in the speed restricted area A1 is improved.

The warning sound that is emitted when the navigation speed exceeds the speed limit in the speed restricted area A1 may be an electronic sound such as a buzzer that is continuously output, or a repeated voice message such as "please decrease your navigation speed".

Furthermore, the information terminal 101 issues a warning by displaying a warning image 13*b* (warning icon) on the display 13 when the PWC 102 enters the entry prohibited area A2 in the running warning application I1.

Furthermore, the information terminal 101 issues a warning by outputting a warning sound from the speaker 103 when the PWC 102 enters the entry prohibited area A2 in the running warning application I1.

The warning sound that is emitted when the PWC 102 enters the entry prohibited area A2 may be an electronic sound such as a buzzer that is continuously output, or a repeated voice message such as "please leave the entry prohibited area".

The position acquirer 14 is operable to acquire current position information 12 on the information terminal 101 (PWC 102) from a positioning satellite 500 every unit positioning time. As an example, "every unit positioning time" refers to "every second". The information terminal 101 acquires the navigation speed of the PWC 102 based on the information terminal 101.

The controller 15 includes a central processing unit (CPU) and storages such as a random access memory (RAM) and a read-only memory (ROM). The controller 15 performs a control to execute the warning application 11. The controller 15 also performs a predetermined control related to an overspeed warning based on the engine speed of the PWC 102. The controller 15 is described below in detail.

The PWC 102 includes the communicator 2, a display 3, an engine 4 including a crankshaft 4*a*, a rotation speed detector 40, a jet propulsion mechanism 5 driven by the engine E, a drive operation unit 6 provided on a handle H, and a controller 7.

The communicator 2 includes a communication antenna communicable with the second communicator 12 of the information terminal 101, and a transmitter/receiver to process transmitted and received information. As an example, the communicator 2 is communicable with the second communicator 12 of the information terminal 101 using a communication standard such as Bluetooth.

As an example, the display 3 is a touch panel liquid crystal display. The display 3 displays various information such as the shift state of the PWC 102 including a neutral state (N), a forward movement state (F), and a reverse movement state (R), and engine speed. The display of the PWC may display a water area map and a warning image by synchronizing (mirroring) its display image with the display image of the information terminal, for example.

The engine 4 obtains a driving force to rotate the crankshaft 4*a* by burning a mixture of air drawn in through an intake passage (not shown) provided in a throttle valve (not shown) and fuel in a combustion chamber.

As shown in FIG. 1, the rotation speed detector 40 detects the engine speed. Specifically, the rotation speed detector 40 is provided on the crankshaft 4*a* to detect the rotation angle of the crankshaft 4*a*.

The jet propulsion mechanism 5 is driven by the engine 4 to take water into a water passage 5*a* including an opening on the lower surface of the rear of the PWC 102, and to eject the taken-in water from a nozzle 52 located at a rear end of the PWC 102. Consequently, the PWC 102 is propelled.

The jet propulsion mechanism 5 includes a drive shaft 50 connected to the crankshaft 4*a*, an impeller 51, the nozzle 52, a deflector 53, and a reverse gate 54 (bucket).

The drive shaft 50 extends in a forward-rearward direction, and includes a front end connected to the crankshaft 4*a* and a rear end in the water passage 5*a*. The impeller 51 is fixed to the vicinity of the rear end of the drive shaft 50.

The impeller 51 rotates together with the drive shaft 50 to generate a flow toward the nozzle 52 within the water passage 5*a*.

The nozzle 52 is located at the most downstream position in the water passage 5*a* in which the impeller 21 is located. The nozzle 52 functions as a water outlet (jetting port). In other words, the nozzle 52 ejects water to generate a propulsive force. The deflector 53 and the reverse gate 54 are installed on the nozzle 52.

The deflector 53 is rotatable in a right-left direction about an axis extending in an upward-downward direction. That is, the deflector 53 is operable to change the direction of the water ejected from the nozzle 52 in the right-left direction. The deflector 53 rotates in the right-left direction in response to an operation of the handle H.

The reverse gate 54 is rotatable in the upward-downward direction about an axis extending in the right-left direction. In other words, the reverse gate 54 is operable to change the direction of the water ejected from the nozzle 52 in the forward-rearward direction. The reverse gate 54 rotates in the upward-downward direction in response to an operation of a reverse deceleration lever 62.

The PWC 102 is in the forward movement state (F) when the reverse gate 54 is located above the nozzle 52 so as to not block the water ejected from the nozzle 52. The PWC 102 is in the reverse movement state (R) when the reverse gate 54 moves downward from the position in the forward movement state (F), i.e., when the reverse gate 54 is located behind the nozzle 52, so as to block the water ejected from the nozzle 52. The PWC 102 is in the neutral state (N) when the reverse gate 54 is located midway between the position of the reverse gate 54 in the forward movement state and the position of the reverse gate 54 in the reverse movement state so as to slightly block the water ejected from the nozzle 52.

As shown in FIG. 2, the drive operation unit 6 includes an engine start switch 60, a throttle lever 61 (accelerator lever), the reverse deceleration lever 62, a rotation speed specification operator 63 (cruise control mode switch) to specify the engine speed by increasing or decreasing the engine speed, and a low rotation speed maintenance switch 64 (no-wake mode switch).

The engine start switch 60 is provided on a left portion of the handle H. The engine start switch 60 is operated to start the engine 4 by driving a starter motor (not shown).

The throttle lever 61 is provided on a right portion of the handle H. The throttle lever 61 is operated to change the engine speed by adjusting the opening of the throttle valve (not shown) of the engine 4. When the throttle lever 61 is operated, the PWC 102 enters the forward movement state in principle. As the amount of operation of the throttle lever 61 increases, the engine speed increases.

The reverse deceleration lever 62 is provided on a left portion of the handle H. The reverse deceleration lever 62 is operated to put the PWC 102 in the reverse movement state by moving the reverse gate 54 downward (rearward of the nozzle 52). The PWC 102 decelerates in the forward movement state when the reverse deceleration lever 62 is also operated while the throttle lever 61 is operated.

The PWC 102 is operable to navigate by specifying the engine speed. As an example, the PWC 102 is operable to switch from a state in which the navigation speed is changed by an accelerator to a cruise control mode in which the engine speed is specified by the rotation speed specification operator 63. The PWC 102 is also operable to switch from the state in which the navigation speed is changed by the accelerator to a low rotation speed maintenance mode (no-wake mode) in which the engine speed is maintained at a predetermined engine speed equal to or lower than a threshold rotation speed.

The controller 15 of the information terminal 101 according to an example embodiment of the present invention performs a control to disable a warning such that the warning is not issued when the engine speed is equal to or lower than the threshold rotation speed even when the navigation speed exceeds the speed limit. That is, the "threshold rotation speed" refers to an engine speed that is a criterion to disable the warning. The threshold rotation speed is set to a value at which the navigation speed is equal to or lower than the speed limit when the engine speed is equal to or lower than the threshold rotation speed in a state in which external forces including wind and waves are not acting on the PWC 102. As an example, the threshold rotation speed is set to a predetermined engine speed at which the navigation speed is 5 mph in a state in which external forces including wind and waves are not acting on the PWC 102. A control to disable an overspeed warning performed by the controller 15 is described below in detail.

The rotation speed specification operator 63 is provided on a right portion of the handle H. The rotation speed specification operator 63 is a switch for the cruise control mode. The cruise control mode refers to a mode in which the engine speed is specified by the rotation speed specification operator 63 to drive the PWC 102.

Specifically, the rotation speed specification operator 63 includes a cruise set switch 63*a*, a rotation speed plus switch 63*b*, and a rotation speed minus switch 63*c*. The cruise set switch 63*a* is operated to start the cruise control mode. When the cruise set switch 63*a* is operated, the engine speed at the time at which the cruise set switch 63*a* is operated is maintained.

The rotation speed plus switch 63*b* is operated to increase the engine speed, and the rotation speed minus switch 63*c* is operated to decrease the engine speed. Specifically, the PWC 102 increases the engine speed by a fixed number each time the rotation speed plus switch 63*b* is pressed once. The PWC 102 decreases the engine speed by a fixed number each time the rotation speed minus switch 63*c* is pressed once.

The low rotation speed maintenance switch 64 (no-wake mode switch) is provided on a right portion of the handle H. The low rotation speed maintenance switch 64 is operated to start a low rotation speed maintenance mode. The low rotation speed maintenance mode refers to a mode in which the engine speed is maintained at the predetermined engine speed that is equal to or lower than the threshold rotation speed.

The controller 7 includes a CPU and storages such as a RAM and a ROM. The controller 7 is an engine control unit (ECU) that controls driving of the engine 4.

The controller 7 transmits various information of the PWC 102 to the information terminal 101 via the communicator 2.

As an example, the controller 7 acquires the engine speed detected by the rotation speed detector 40 and transmits the engine speed to the information terminal 101.

The controller 7 also transmits, to the information terminal 101, information indicating the shift state of the PWC 102 including the neutral state (N), the forward movement state (F), and the reverse movement state (R).

The controller 7 also transmits, to the information terminal 101, information indicating that the PWC 102 is in the cruise control mode and information indicating that the PWC 102 is in the no-wake mode.

As described above, the controller 15 of the information terminal 101 performs a control to disable the warning such that the overspeed warning is not issued when the engine speed is equal to or lower than the threshold rotation speed even when the navigation speed exceeds the speed limit. Such a control is performed to prevent the controller 15 from performing a control to issue a warning when the navigation speed of the PWC 102 increases due to the influence of external forces including wind and waves although the vessel operator U has decreased the propulsive force of the PWC 102 in the speed restricted area A1.

As an example, the overspeed warning is disabled in the following case. The controller 15 disables the warning when a specified engine speed is equal to or lower than the threshold rotation speed.

Specifically, the controller 15 disables the warning such that the warning is not issued when the engine speed is specified to be a value equal to or lower than the threshold rotation speed by the rotation speed specification operator 63 in the cruise control mode even when the navigation speed exceeds the speed limit. Furthermore, the controller 15 disables the warning such that the warning is not issued when the mode is switched to the low rotation speed maintenance mode even when the navigation speed exceeds the speed limit.

In addition, the controller 15 disables the warning such that the warning is not issued when the PWC 102 is in the reverse movement state (R) or the neutral state (N).

The overspeed warning is disabled in the following manner. When the engine speed is equal to or lower than the threshold rotation speed, the controller 15 disables the warning such that the warning image 13*a* (warning icon) is not displayed on the display 13. Furthermore, when the engine speed is equal to or lower than the threshold rotation speed, the controller 15 disables the warning such that the warning sound is not output from the speaker 103.

Figure 6:
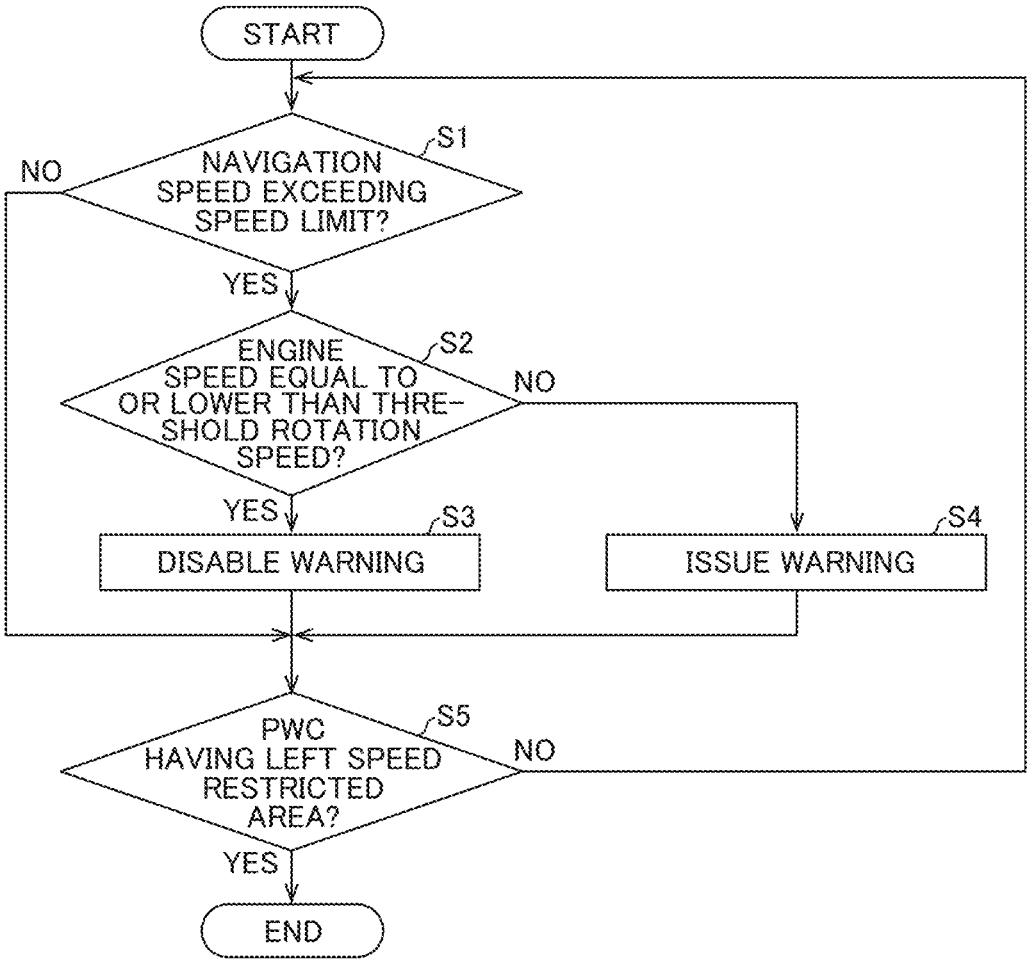
FIG. 6 is a flowchart of a control process to disable an overspeed warning in a vessel operator warning support method according to an example embodiment of the present invention.

A control process flow of the vessel operator warning support method executed by the controller 15 to disable the overspeed warning is now described with reference to FIG. 6. The control process flow is assumed to start when the PWC 102 enters the speed restricted area A1.

In step S1, it is determined whether or not the navigation speed of the PWC 102 acquired based on the position information 12 exceeds the speed limit. When the navigation speed of the PWC 102 exceeds the speed limit, the process advances to step S2. When the navigation speed of the PWC 102 does not exceed the speed limit, the process advances to step S5.

In step S2, it is determined whether or not the engine speed is equal to or lower than the threshold rotation speed. When the engine speed is equal to or lower than the threshold rotation speed, the process advances to step S3. When the engine speed is higher than the threshold rotation speed, the process advances to step S4. When the PWC 102 is in the reverse movement state or the neutral state, the engine speed is equal to or lower than the threshold rotation speed. When the PWC 102 is in the low rotation speed maintenance mode (no-wake mode) or when the engine speed is specified to be a value equal to or lower than the threshold rotation speed by the rotation speed specification operator 63 in the cruise control mode, the engine speed is equal to or lower than the threshold rotation speed. That is, when the PWC 102 is in the reverse movement state, the neutral state, or the low rotation speed maintenance mode, the process advances to step S3.

In step S3, the warning is disabled such that the overspeed warning is not issued. That is, the warning image 13*a* (warning icon) is not displayed on the display 13, and/or the warning sound is not output from the speaker 103. Then, the process advances to step S5.

On the other hand, in step S4, the overspeed warning is issued, and then the process advances to step S5.

In step S5, it is determined whether or not the PWC 102 has left the speed restricted area A1. When the PWC 102 has left the speed restricted area A1, the control process is terminated. When the warning is being issued at the time at which the PWC 102 leaves the speed restricted area A1, the warning is terminated when the PWC 102 leaves the speed restricted area A1. When the PWC 102 has not left the speed restricted area A1, the process returns to step S1.

Figure 7:
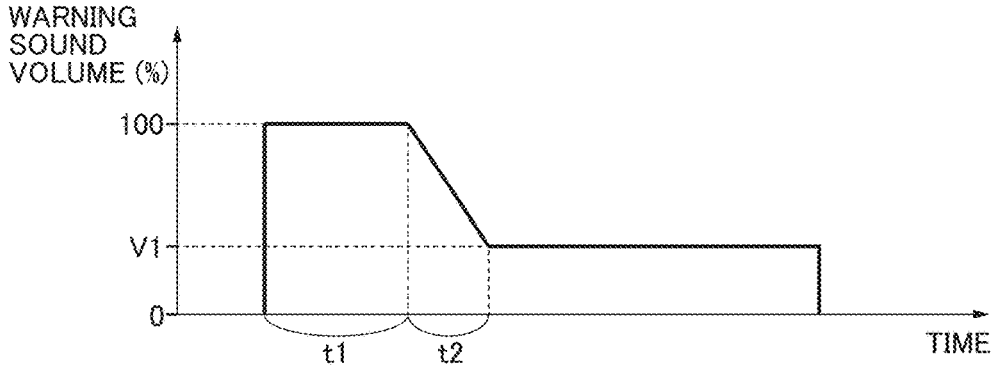
FIG. 7 is a diagram illustrating a relationship between a volume and a duration of time of a warning sound.

As shown in FIG. 7, the controller 15 of the information terminal 101 performs a control to decrease a warning sound volume when a first period of time t1 has elapsed from the start of output of the warning sound. Such a control is performed to prevent the warning sound from being continuously output at an extremely loud volume.

The controller 15 decreases the warning sound volume to half or less of the volume at the start of output of the warning sound when the first period of time t1 has elapsed from the start of output of the warning sound. As an example, when the volume at the start of output of the warning sound is 100%, the decreased warning sound volume V1 (minimum warning sound volume) is set to about 30%.

The controller 15 gradually decreases the warning sound volume for a second period of time t2 that is shorter than the first period of time t1 (t1>t2) when the first period of time t1 has elapsed from the start of output of the warning sound. As an example, the first period of time t1 is set to about 30 seconds, and the second period of time t2 is set to about 5 seconds. That is, the controller 15 gradually decreases the warning sound volume over the second period of time t2 from a time point at which the first period of time t1 has elapsed.

The PWC 102 outputs the warning sound from the speaker 103 to issue the warning not only when the navigation speed exceeds the speed limit in the speed restricted area A1, but also when the PWC 102 enters the entry prohibited area A2. The controller 15 starts to output the warning sound when the PWC 102 enters the entry prohibited area A2. Then, the controller 15 gradually decreases the warning sound volume over the second period of time t2 from the time point at which a first period of time t1 has elapsed from the start of output of the warning sound.

Figure 8:
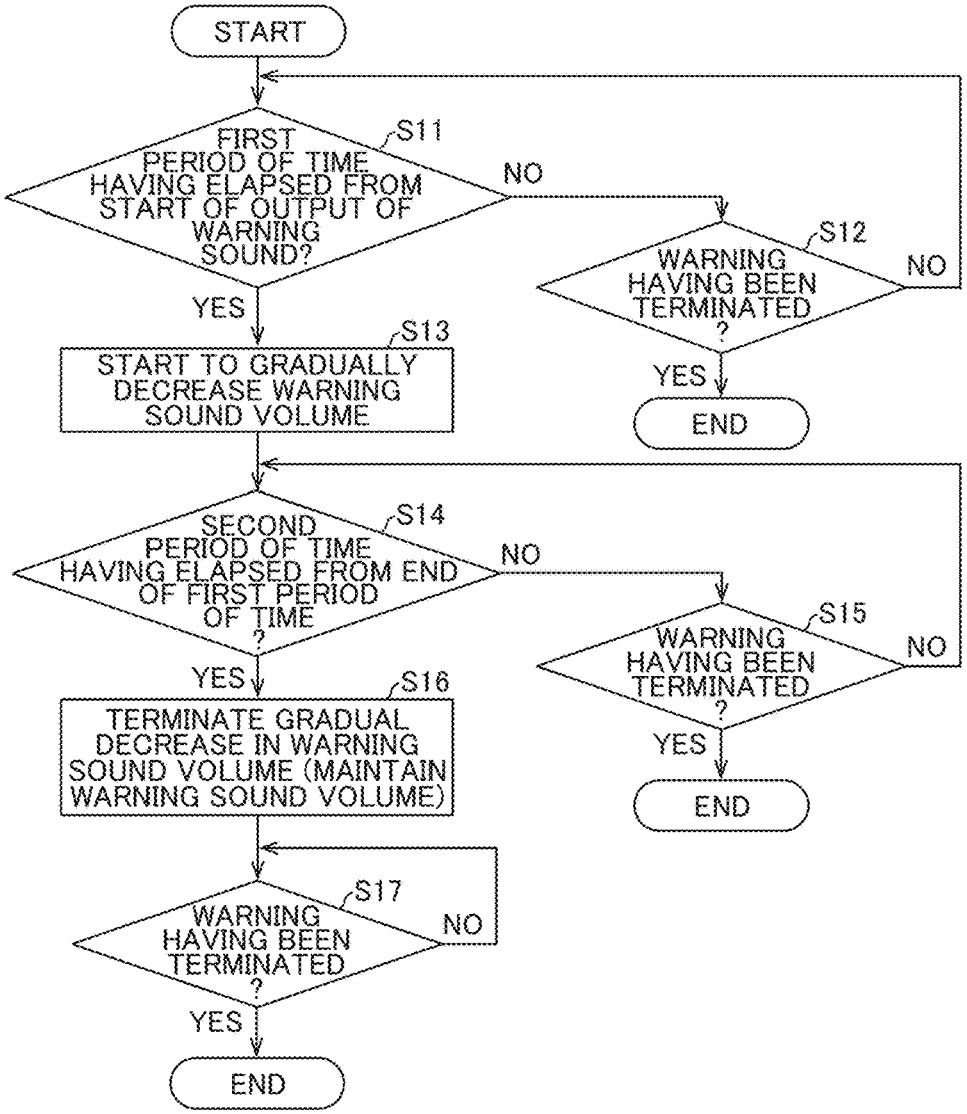
FIG. 8 is a flowchart of a control process to decrease a warning sound volume halfway in a vessel operator warning support method according to an example embodiment of the present invention.

A control process flow of the vessel operator warning support method executed by the controller 15 to decrease the warning sound volume halfway is now described with reference to FIG. 8. The control process flow is assumed to start when the output of the warning sound from the speaker 103 is started.

In step S11, it is determined whether or not the first period of time t1 has elapsed from the start of output of the warning sound from the speaker 103. When the first period of time t1 has elapsed, the process advances to step S13. When the first period of time t1 has not elapsed, the process advances to step S12.

In step S12, it is determined whether or not the warning has been terminated. When the warning has been terminated, the control process is terminated. When the warning has not been terminated, the process returns to step S11. The warning is terminated when the PWC 102 leaves the speed restricted area A1 and the entry prohibited area A2, or when the navigation speed in the speed restricted area A1 is decreased to the speed limit or lower and the cause of the warning is eliminated, for example.

In step S13, the warning sound volume starts to be gradually decreased. As an example, there is a proportional relationship between a change in the warning sound volume and time. Then, the process advances to step S14.

In step S14, it is determined whether or not the second period of time t2 has elapsed from the end of the first period of time t1. When the second period of time t2 has elapsed, the process advances to step S16. When the second period of time t2 has not elapsed, the process advances to step S15.

In step S15, it is determined whether or not the warning has been terminated. When the warning has been terminated, the control process is terminated. When the warning has not been terminated, the process returns to step S14.

In step S16, a gradual decrease in the warning sound volume is terminated. That is, the warning sound volume is maintained at V1, and then the process advances to step S17.

In step S17, it is determined whether or not the warning has been terminated. When the warning has been terminated, the control process is terminated. When the warning has not been terminated, the process operation in step S17 is repeated.

Figure 9:
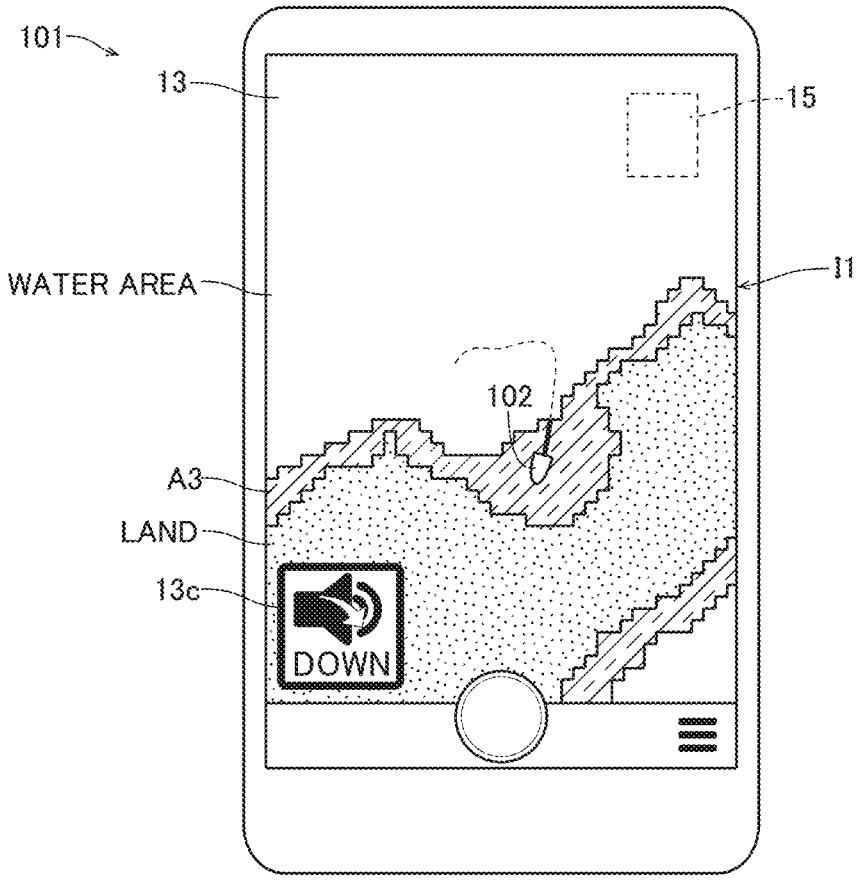
FIG. 9 is a diagram showing a notification screen on a display of an information terminal according to an example embodiment of the present invention when a personal watercraft enters an audio restricted area.

As shown in FIG. 9, the information terminal 101 displays an audio restricted area A3 in the water area map I10 on the display 13 in the running warning application I1.

The audio restricted area A3 refers to an area in which an audio sound volume is restricted and in which it is required to navigate as quietly as possible. As an example, the audio restricted area A3 is set in an area within a predetermined distance from the shoreline. The audio restricted area may partially or completely coincide with the speed restricted area. Furthermore, the audio restricted area may partially or completely coincide with the entry prohibited area.

Figure 10:
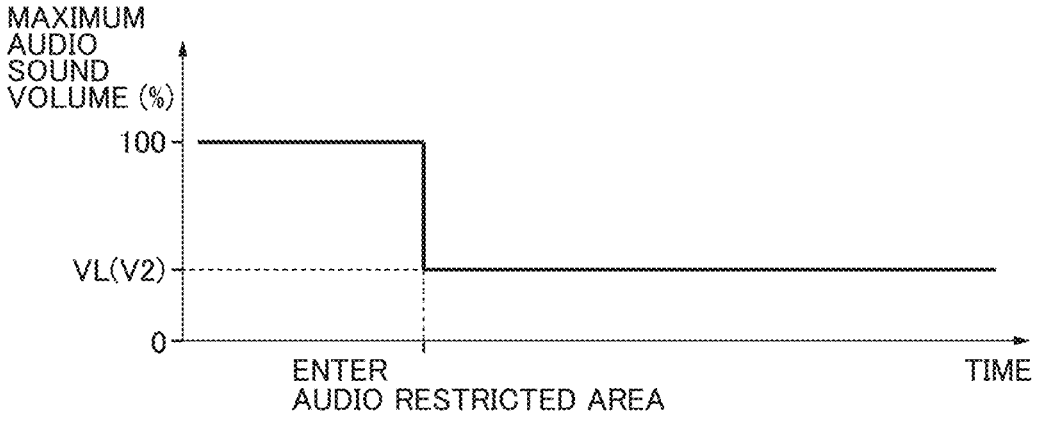
FIG. 10 is a diagram illustrating a change in a maximum audio sound volume before and after a personal watercraft enters an audio restricted area.

As shown in FIG. 10, the controller 15 of the information terminal 101 performs a control to decrease the audio sound volume when the audio sound volume is greater than a threshold sound volume VL when the PWC 102 enters the audio restricted area A3. Specifically, the controller 15 decreases the audio sound volume to the threshold sound volume or less when the PWC 102 enters the audio restricted area A3. As an example, when the threshold sound volume is set to half of a maximum sound volume, the controller 15 decreases a maximum sound volume V2 to at least half or less of a maximum audio sound volume (100%) at the time at which the PWC 102 enters the audio restricted area A3. The threshold sound volume includes a pattern in which the threshold sound volume is a predetermined decibel value (volume setting value) and a pattern in which the threshold sound volume is a predetermined percentage of the maximum output of the audio sound. When the threshold sound volume is the predetermined decibel value, the controller of the information terminal decreases a decibel value of the audio sound to the predetermined decibel value equal to or less than the threshold sound volume when the decibel value of the audio sound is greater than the threshold sound volume set by a decibel value when the PWC enters the audio restricted area. Furthermore, there may be various audio restricted areas, and a threshold may be set for each of the various areas. Moreover, the degree to which the audio sound volume is decreased may differ for each of the various areas.

As an example, the threshold sound volume VL is set to 30% of the maximum audio sound volume. In such a case, when the audio sound volume is 60% of the maximum sound volume when the PWC 102 enters the audio restricted area A3, the controller 15 performs a control to decrease the maximum audio sound volume V2 to 30% of the maximum audio sound volume before the control process (before the control process to decrease the maximum audio sound volume). In other words, the sound volume is halved.

The controller may cause the decreased maximum audio sound volume V2 to be lower than the threshold sound volume VL, such as 20% or 15% of the maximum audio sound volume before the control process to decrease the maximum audio sound volume, rather than 30% that is the same as the threshold sound volume VL.

The controller 15 performs a control to notify the vessel operator U that the audio sound volume is greater than the threshold sound volume when the audio sound volume is greater than the threshold sound volume VL when the PWC 102 enters the audio restricted area A3.

As an example, the information terminal 101 (controller 15) displays a notification image 13*c* (notification icon) on the display 13 to provide a notification in the running warning application I1.

Figure 11:
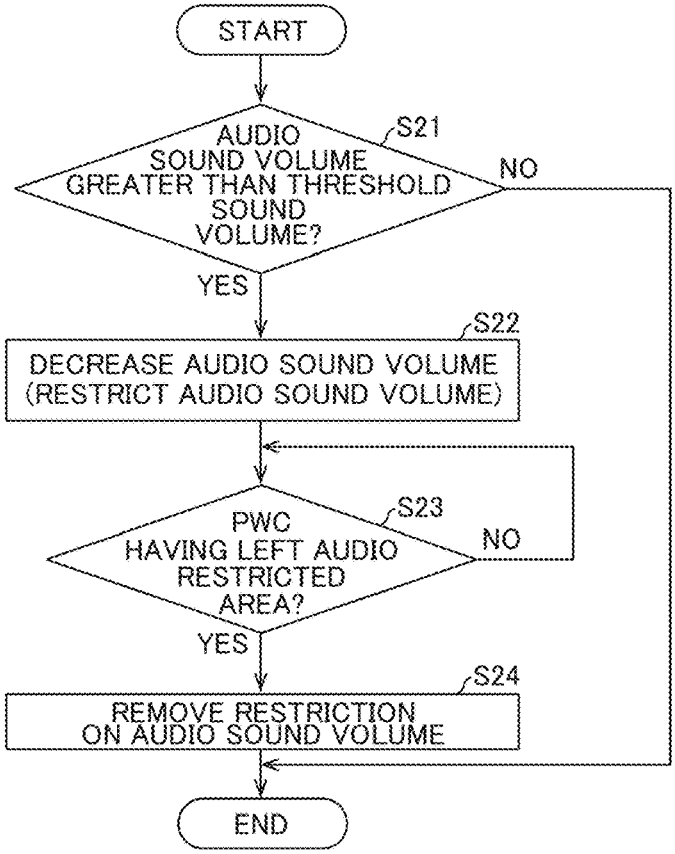
FIG. 11 is a flowchart of a control process to decrease an audio sound volume in a vessel operator warning support method according to an example embodiment of the present invention.

A control process flow of the vessel operator warning support method executed by the controller 15 to decrease the audio sound volume is now described with reference to FIG. 11. The control process flow is assumed to start when the PWC 102 enters the audio restricted area A3.

In step S21, it is determined whether or not the audio sound volume is greater than the threshold sound volume VL. When the audio sound volume is greater than the threshold sound volume VL, the process advances to step S22. When the audio sound volume is equal to or lower than the threshold sound volume VL, the control process is terminated.

In step S22, the audio sound volume is decreased, and then the process advances to step S23.

In step S23, it is determined whether or not the PWC 102 has left the audio restricted area A3. When the PWC 102 has left the audio restricted area A3, the process advances to step S24. When the PWC 102 has not left the audio restricted area A3, the process operation in step S23 is repeated.

In step S24, the restriction on the audio sound volume is removed. That is, the audio sound volume is returned to the setting before the PWC 102 enters the audio restricted area A3, and the control process is terminated.

Figure 12:
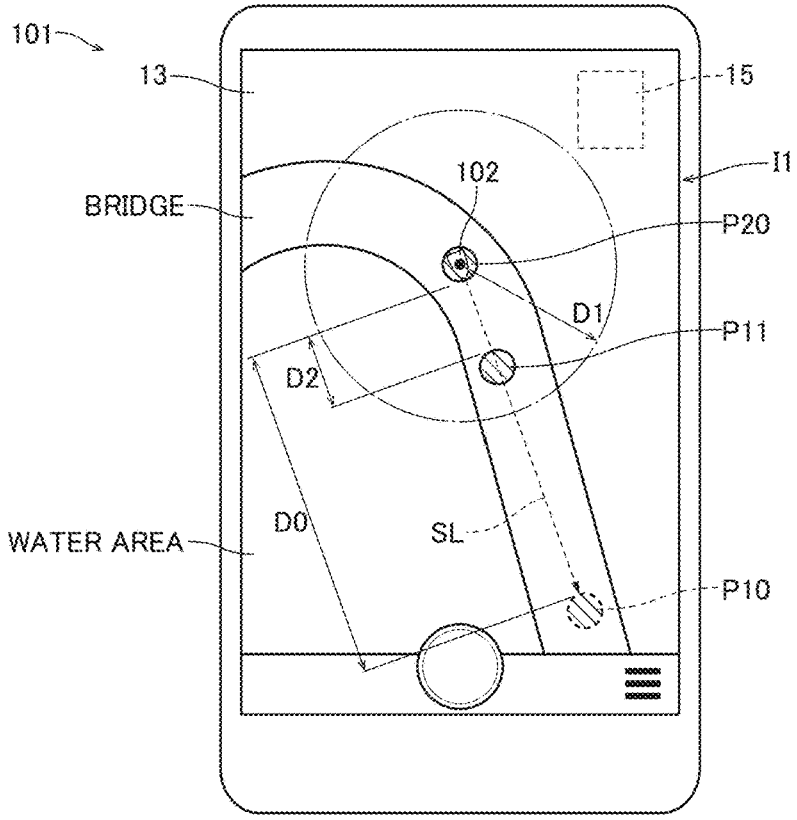
FIG. 12 is a diagram showing a previous position, a current position, and a corrected current position on a display of an information terminal according to an example embodiment of the present invention.

As shown in FIG. 12, when the PWC 102 is located under a structure such as a bridge, the PWC 102 may not be able to acquire accurate position information 12 from the positioning satellite 500 every unit positioning time (e.g., every second). In such a case, the current position P10 of the PWC 102 may deviate significantly from the previous position P20 of the PWC 102.

As an example, when the PWC 102 is navigating while maintaining an engine speed of 7700 rpm that corresponds to a speed of 30 meters per second, the current position P10 may be 200 meters away from the previous position P20 one second ago (D0=200 m). In such a case, a distance DO between the current position P10 and the previous position P20 is never actually greater than 30 meters, and thus the current position P10 is in an inaccurate position.

Therefore, the controller 15 of the information terminal 101 performs a control to correct the current position P10 to become closer to the previous position P20 and set a corrected current position P11 when the distance DO between the current position P10 of the PWC 102 indicated by the current position information 12 and the previous position P20 of the PWC 102 indicated by the previous position information 12 is equal to or greater than a threshold distance D1.

When the corrected current position is set, it is not necessary to display the current position on the display of the information terminal. Furthermore, when the corrected current position is set, a predetermined display may be provided on the display of the information terminal such that the vessel operator is able to recognize that the corrected current position has been set.

The threshold distance D1 is set to a relatively large distance that the PWC 102 is not able to move within the unit positioning time. As an example, the threshold distance D1 is set to a variable distance that increases or decreases depending on the current navigation speed of the PWC 102. Specifically, the threshold distance D1 is set to a distance obtained by multiplying the current navigation speed of the PWC 102 by a predetermined coefficient greater than 1. Alternatively, the threshold distance may be set to a distance obtained by multiplying the maximum navigation speed that the PWC is able to output by the unit positioning time.

The controller 15 sets a separation distance D2 from the previous position P20 to the corrected current position P11 based on the navigation speed of the PWC 102 at the previous position P20. The separation distance D2 is set to a distance smaller than the threshold distance D1.

The controller 15 acquires the navigation speed used to set the separation distance D2 based on the detection result of the rotation speed detector 40 of the PWC 102. As an example, the controller 15 sets the separation distance D2 to 10 meters when the navigation speed of the PWC 102 is an engine speed of 4000 rpm that corresponds to a speed of 10 meters per second. The navigation speed used to set the separation distance may be acquired based on position information from the positioning satellite instead of the detection result of the rotation speed detector.

The controller 15 sets the corrected current position P11 at a position that is the separation distance D2 (10 m) away from the previous position P20 and on a straight line SL connecting the current position P10 to the previous position P20. The corrected current position may be set based on the heading of the PWC at the previous position, for example, instead of setting the corrected current position on the straight line connecting the current position to the previous position.

Figure 13:
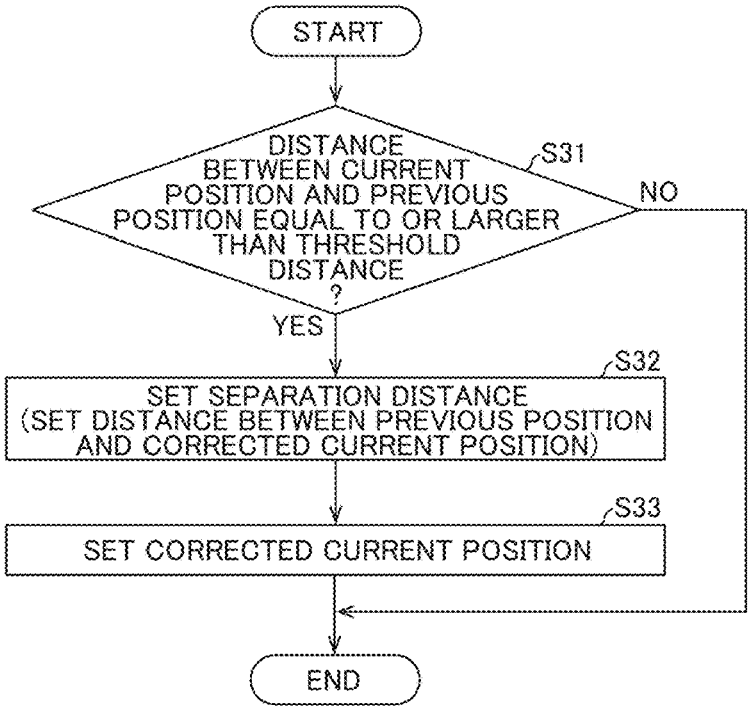
FIG. 13 is a flowchart of a control process to correct a positional deviation of a personal watercraft in a vessel operator warning support method according to an example embodiment of the present invention.

A control process flow of the vessel operator warning support method executed by the controller 15 to correct the positional deviation of the PWC 102 is now described with reference to FIG. 13.

In step S31, it is determined whether or not the distance DO between the current position P10 and the previous position P20 is equal to or larger than the threshold distance D1. When the distance DO between the current position P10 and the previous position P20 is equal to or larger than the threshold distance D1, the process advances to step S32. When the distance DO between the current position P10 and the previous position P20 is smaller than the threshold distance D1, the control process is terminated.

In step S32, the navigation speed of the PWC 102 at the previous position P20 is acquired based on the detection result of the rotation speed detector 40, and the separation distance D2 from the previous position P20 to the corrected current position P11 is set based on the acquired navigation speed. Then, the process advances to step S33.

In step S33, the corrected current position P11 is set on the straight line SL connecting the current position P10 to the previous position P20, and the control process is terminated.

Figure 14:
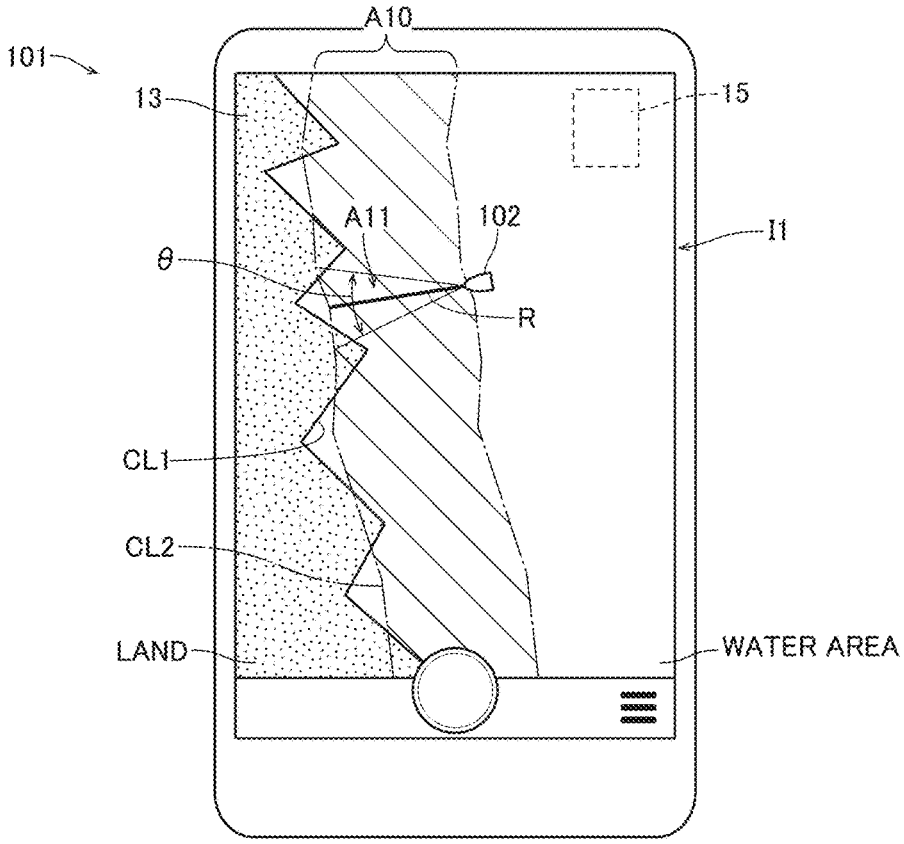
FIG. 14 is a diagram showing a near-shoreline area and a target navigation route on a display of an information terminal according to an example embodiment of the present invention.

As shown in FIG. 14, in a near-shoreline area A10, which is within a certain distance (within 200 m, for example) from a shoreline CL1, meandering or zigzagging navigation of the PWC 102 is considered bad manners. Therefore, when the PWC 102 passes through the near-shoreline area A10 to dock or undock, it is considered good manners to linearly move away from or toward the shoreline CL1 such that the navigation distance of the PWC 102 in the near-shoreline area A10 is as short as possible. The near-shoreline area A10 is an example of a "location alert area".

Therefore, when the PWC 102 is located in the near-shoreline area A10, the controller 15 of the information terminal 101 automatically sets, in the near-shoreline area A10, a target navigation route R that linearly extends in a direction away from the shoreline CL1 such that the navigation distance of the PWC 102 in the near-shoreline area A10 is decreased.

The controller 15 issues a predetermined warning when the PWC 102 deviates from the target navigation route R, and does not issue the predetermined warning when the PWC 102 moves along the target navigation route R.

As an example, a case in which the PWC 102 deviates from the target navigation route R refers to a case in which the PWC 102 goes out of a range A11 of a predetermined angle θ ahead of the PWC 102 that is set about the bow direction of the PWC 102 when the PWC 102 enters the near-shoreline area A10. In addition, a case in which the PWC deviates from the target navigation route may refer to a case in which the PWC is away from the target navigation route by a predetermined distance or more.

When the target navigation route R is automatically set, the controller 15 creates a shoreline model CL2 that is smoothed to reduce the irregularities of the shoreline CL1, and automatically sets, in the near-shoreline area A10, the target navigation route R that linearly extends in a direction away from the shoreline model CL2 such that the navigation distance of the PWC 102 in the near-shoreline area A10 is minimized. As an example, the least squares method is used to create the shoreline model CL2 by smoothing. In addition, a predetermined approximate curve or the like may be used to create the shoreline model by smoothing.

When the shoreline model CL2 is created, the controller 15 acquires the map information I3 (see FIG. 5) in which the shoreline CL1 is represented by a straight line from the cloud server CS.

Figure 15:
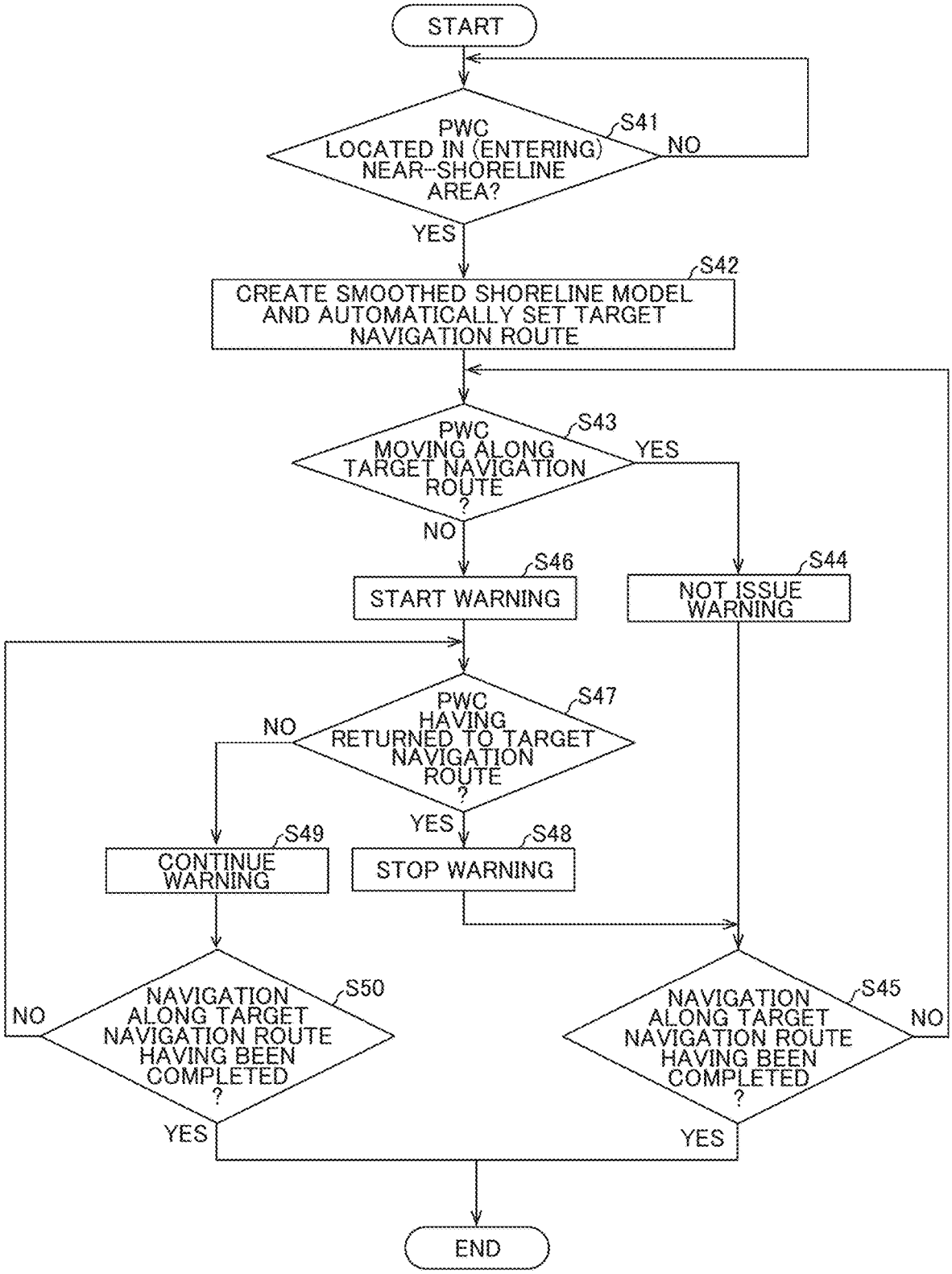
FIG. 15 is a flowchart of a control process to automatically set a target navigation route in a near-shoreline area in a vessel operator warning support method according to an example embodiment of the present invention.

A control process flow of the vessel operator warning support method executed by the controller 15 to automatically set the target navigation route R in the near-shoreline area A10 is now described with reference to FIG. 15.

In step S41, it is determined whether or not the PWC 102 is located in the near-shoreline area A10. When the PWC 102 is docking, it is determined whether or not the PWC 102 has entered the near-shoreline area A10, and when the PWC 102 is undocking, it is determined whether or not the PWC 102 has started to move away from the shore in the near-shoreline area A10. When it is determined in step S41 that the PWC 102 is located in the near-shoreline area A10, the process advances to step S42. When it is determined in step S41 that the PWC 102 is not located in the near-shoreline area A10, the process operation in step S41 is repeated.

In step S42, the smoothed shoreline model CL2 is created, and the target navigation route R is automatically set such that the navigation distance of the PWC 102 in the near-shoreline area A10 is minimized (about 200 m, for example). Then, the process advances to step S43.

In step S43, it is determined whether or not the PWC 102 is moving along the target navigation route R. When the PWC 102 is moving along the target navigation route R, the process advances to step S44. When the PWC 102 is not moving along the target navigation route R (when the PWC 102 has deviated from the target navigation route R), the process advances to step S46.

In step S44, a warning is not issued because the PWC 102 is moving correctly along the target navigation route R. Then, the process advances to step S45.

In step S45, it is determined whether or not the navigation of the PWC 102 along the target navigation route R has been completed. As an example, the completion of the navigation along the target navigation route R is determinable from the position information 12 on the information terminal 101 (PWC 102). When the navigation along the target navigation route R has been completed, the control process is terminated. When the navigation along the target navigation route R has not been completed, the process returns to step S43.

In step S46, a warning is started (issued). The warning in this case may be issued by outputting a predetermined warning sound from the speaker or by displaying a predetermined warning image (not shown) on the display of the information terminal. Then, the process advances to step S47.

In step S47, it is determined whether or not the PWC 102 has returned to the target navigation route R. When the PWC 102 has returned to the target navigation route R, the process advances to step S48. When the PWC 102 has not returned to the target navigation route R, the process advances to step S49.

In step S48, the warning is stopped, and then the process advances to step S45.

In step S49, the warning is continued, and then the process advances to step S50.

In step S50, it is determined whether or not the navigation of the PWC 102 along the target navigation route R has been completed. When the navigation along the target navigation route R has been completed, the control process is terminated. When the navigation along the target navigation route R has not been completed, the process returns to step S47.

In the structures according to the example embodiments of the present invention, the following advantageous effects are achieved.

According to an example embodiment of the present invention, as described above, the vessel operator warning support system 100 includes the controller 15 configured or programmed to perform a control to disable the warning such that the warning is not issued when the engine speed is equal to or lower than the threshold rotation speed even when the navigation speed exceeds the speed limit. Accordingly, it is determined whether or not the warning is issued by taking into consideration not only the navigation speed based on the position information 12, which is affected by external forces including wind and waves, but also the engine speed, which is not affected by external forces including wind and waves. Therefore, even when the navigation speed exceeds the speed limit, the warning is not issued when the PWC is being operated at an engine speed at which the propulsive force is relatively small, such as at which the propulsive force becomes substantially zero. Therefore, when external forces including wind and waves act on a hull such that the navigation speed increases, the possibility that the warning is issued that the navigation speed exceeds the speed limit is reduced or prevented.

According to an example embodiment of the present invention, as described above, the threshold rotation speed is set to a value at which the navigation speed is equal to or lower than the speed limit when the engine speed is equal to or lower than the threshold rotation speed in a state in which external forces including wind and waves are not acting. Accordingly, when the PWC is being operated under action of external forces including wind and waves at an engine speed that maintains the navigation speed at or below the speed limit in a state in which external forces including wind and waves are not acting, the possibility that the warning is issued that the navigation speed exceeds the speed limit is more reliably reduced or prevented.

According to an example embodiment of the present invention, as described above, the PWC 102 is operable to navigate by specifying an engine speed, and the controller 15 is configured or programmed to disable the warning when the specified engine speed is equal to or lower than the threshold rotation speed. Accordingly, the engine speed is specified, and thus the engine speed is specified to be the threshold rotation speed such that the possibility that the warning is issued that the navigation speed exceeds the speed limit is more reliably reduced or prevented.

According to an example embodiment of the present invention, as described above, the PWC 102 is operable to switch from a state in which the navigation speed is changed by the accelerator to the low rotation speed maintenance mode in which the engine speed is maintained at the predetermined engine speed equal to or lower than the threshold rotation speed, and the controller 15 is configured or programmed to disable the warning such that the warning is not issued when the PWC 102 switches to the low rotation speed maintenance mode even when the navigation speed exceeds the speed limit. Accordingly, even when the navigation speed exceeds the speed limit, the warning is easily and reliably disabled when the low rotation speed maintenance mode is selected.

According to an example embodiment of the present invention, as described above, the PWC 102 includes the rotation speed specification operator 63 to specify the engine speed by increasing or decreasing the engine speed, and is operable to switch from a state in which the navigation speed is changed by the accelerator to the cruise control mode in which the engine speed is specified by the rotation speed specification operator 63, and the controller 15 is configured or programmed to disable the warning such that the warning is not issued when the engine speed is specified to be a value equal to or lower than the threshold rotation speed by the rotation speed specification operator 63 in the cruise control mode even when the navigation speed exceeds the speed limit. Accordingly, the warning is disabled simply by switching to the cruise control mode and specifying the engine speed to be a value equal to or lower than the threshold rotation speed using the rotation speed specification operator 63, and thus it is easy to disable the warning.

According to an example embodiment of the present invention, as described above, the information terminal 101 is operable to acquire the current position information 12 from the positioning satellite 500 every unit positioning time. Accordingly, the information terminal 101 acquires the current position information 12 from the positioning satellite 500 every unit positioning time, and thus the navigation speed is easily acquired.

According to an example embodiment of the present invention, as described above, the controller 15 is configured or programmed to disable the warning such that the warning is not issued regardless of the engine speed when the PWC 102 is in the reverse movement state. Accordingly, in the reverse movement state in which the navigation speed is restricted to a relatively low speed, the overspeed warning is not issued.

According to an example embodiment of the present invention, as described above, the information terminal 101 includes the display 13, and is operable to, when the navigation speed exceeds the speed limit in the speed restricted area A1, issue the warning by displaying the warning image on the display 13, and the controller 15 is configured or programmed to disable the warning such that the warning image is not displayed on the display 13 when the engine speed is equal to or lower than the threshold rotation speed. Accordingly, the warning is disabled such that the warning image, which is a visual warning to be issued for the vessel operator U, is not displayed on the display 13.

According to an example embodiment of the present invention, as described above, the vessel operator warning support system 100 further includes the speaker 103 on the PWC 102 to output the warning sound as the warning, the information terminal 101 is operable to issue the warning by outputting the warning sound from the speaker 103 when the navigation speed exceeds the speed limit in the speed restricted area A1, and the controller 15 is configured or programmed to disable the warning such that the warning sound is not output from the speaker 103 when the engine speed is equal to or lower than the threshold rotation speed. Accordingly, the warning is disabled such that the warning sound, which is an auditory warning to be issued for the vessel operator U, is not output from the speaker 103.

According to an example embodiment of the present invention, as described above, the controller 15 is configured or programmed to perform a control to decrease the warning sound volume when the first period of time t1 has elapsed from the start of output of the warning sound. In the field of small marine vessels, it has been common practice to output a warning sound at a relatively loud volume such that the warning sound is not difficult to hear due to engine noise, for example, taking into consideration that a vessel operator is not surrounded by the body of a marine vessel as in an automobile, but is instead surrounded by an open area. However, when a warning sound is output at a relatively loud volume, the warning sound may become a disturbance to the surrounding environment, and thus it is necessary to output the warning sound at a volume that takes the surrounding environment into consideration. In order to solve such a problem, the structure described above has been devised. Thus, the warning sound is prevented from continuing to be output at a relatively loud volume at the start of output. Consequently, the warning sound is output at a volume that takes the surrounding environment into consideration. Furthermore, the warning sound volume is decreased during output of the warning sound, and thus the warning sound is decreased after the vessel operator U is made aware that the warning sound is being output.

According to an example embodiment of the present invention, as described above, the controller 15 is configured or programmed to decrease the warning sound volume to half or less of the volume at the start of output of the warning sound when the first period of time t1 has elapsed from the start of output of the warning sound. Accordingly, the warning sound becomes relatively small, and thus the warning sound is output at a volume that takes the surrounding environment into consideration.

According to an example embodiment of the present invention, as described above, the controller 15 is configured or programmed to gradually decrease the warning sound volume over the second period of time t2 that is shorter than the first period of time t1 when the first period of time t1 has elapsed from the start of output of the warning sound. Accordingly, the warning sound volume is gradually decreased over the second period of time t2, which is a relatively short period of time, and thus as compared with a case in which the warning sound volume is instantaneously decreased, the vessel operator U is more reliably made aware that the warning sound continues to be output even when the volume has been decreased.

According to an example embodiment of the present invention, as described above, the location alert area includes the entry prohibited area A2 in which entry of the PWC 102 is prohibited, the information terminal 101 is operable to issue the warning by outputting the warning sound from the speaker 103 not only when the navigation speed exceeds the speed limit in the speed restricted area A1 but also when the PWC 102 enters the entry prohibited area A2, and the controller 15 is configured or programmed to decrease the warning sound volume when the first period of time t1 has elapsed from the start of output of the warning sound that is at a time point at which the PWC 102 enters the entry prohibited area A2. Accordingly, not only the warning sound for overspeed, but also the warning sound output when the PWC 102 enters the entry prohibited area A2 is decreased in volume after the vessel operator U is made aware that the warning sound is being output.

According to an example embodiment of the present invention, as described above, the vessel operator warning support system 100 further includes the speaker 103 on the PWC 102 to output the warning sound as the warning and the audio sound including music, and the controller 15 is configured or programmed to perform at least one of a control to decrease the audio sound volume or a control to notify the vessel operator U that the audio sound volume is equal to or greater than the threshold sound volume when the audio sound volume is equal to or greater than the threshold sound volume when the PWC 102 enters the audio restricted area in which the audio sound volume is restricted. In the field of small marine vessels, it has been common practice to set an audio sound volume to a relatively loud level such that the audio sound is not difficult to hear due to engine noise, for example, taking into consideration that a vessel operator is not surrounded by the body of a marine vessel as in an automobile, but is instead surrounded by an open area. However, when an audio sound volume is set to a relatively loud level, the audio sound may become a disturbance to the surrounding environment, and thus it is necessary to output the audio sound at a volume that takes the surrounding environment into consideration. In order to solve such a problem, the structure described above has been devised. Thus, when the audio sound volume is equal to or greater than the threshold sound volume (when the volume is relatively loud) when the PWC 102 enters the audio restricted area, the audio sound volume is automatically decreased and/or the vessel operator U is made aware that the audio sound volume is relatively loud. Therefore, the possibility that the audio sound continues to be output at a relatively loud volume is reduced or prevented. Consequently, the audio sound is output at a volume that takes the surrounding environment into consideration.

According to an example embodiment of the present invention, as described above, the controller 15 is configured or programmed to decrease the audio sound volume to the threshold sound volume or less when the audio sound volume is greater than the threshold sound volume when the PWC 102 enters the audio restricted area. Accordingly, the audio sound becomes relatively small, and thus the audio sound is output at a volume that takes the surrounding environment into consideration.

According to an example embodiment of the present invention, as described above, the information terminal 101 is operable to acquire the current position information 12 from the positioning satellite 500 every unit positioning time, and the controller 15 is configured or programmed to perform a control to correct the current position P10 to become closer to the previous position P20 and set the corrected current position P11 when the distance DO between the current position P10 of the PWC 102 indicated by the current position information 12 and the previous position P20 of the PWC 102 indicated by the previous position information 12 is equal to or larger than the threshold distance D1. Conventionally, when a small marine vessel is located under a structure such as a bridge, accurate position information may not be acquired from a positioning satellite, and thus the current position of the small marine vessel may significantly deviate from its previous position, and improvements are required. When the current position of the small marine vessel significantly deviates from its previous position, the navigation speed may be erroneously determined to exceed the speed limit due to inaccurate position information such that an overspeed warning is erroneously issued, for example, and thus it is not preferable to significantly deviate the current position of the small marine vessel from its previous position. In order to solve such a problem, the structure described above has been devised. Thus, when the distance DO between the current position P10 and the previous position P20 of the PWC 102 is equal to or larger than the threshold distance D1, the current position P10 is corrected to become closer to the previous position P20 such that the corrected current position P11 is set. Thus, a significant deviation of the current position P10 of the PWC 102 from the previous position P20 is reduced or prevented. Therefore, more accurate position information is acquired, and thus the navigation speed is acquired more accurately based on the position information. Consequently, the possibility that the navigation speed is erroneously determined to exceed the speed limit due to inaccurate position information such that an overspeed warning is erroneously issued is reduced or prevented, for example.

According to an example embodiment of the present invention, as described above, the controller 15 is configured or programmed to set the separation distance D2 from the previous position P20 to the corrected current position P11 based on the navigation speed of the PWC 102 at the previous position P20. Accordingly, the separation distance D2 is set based on the navigation speed, and thus the corrected current position P11 is set easily and accurately.

According to an example embodiment of the present invention, as described above, the PWC 102 includes the rotation speed detector to detect the engine speed, and the controller 15 is configured or programmed to acquire the navigation speed used to set the separation distance D2 based on the detection result of the rotation speed detector. Accordingly, the navigation speed is acquired based on the engine speed, rather than on position information with uncertain accuracy in which the PWC 102 is highly likely to be positionally deviated, and thus the corrected current position P11 is set more accurately.

According to an example embodiment of the present invention, as described above, the controller 15 is configured or programmed to set the corrected current position P11 on the straight line SL connecting the current position P10 to the previous position P20. Accordingly, the corrected current position P11 is set on the straight line SL connecting the current position P10 to the previous position P20, and thus it is easy to set the corrected current position P11.

According to an example embodiment of the present invention, as described above, the information terminal 101 is operable to automatically set, in the near-shoreline area A10, the target navigation route R that linearly extends in the direction away from the shoreline such that the navigation distance of the PWC 102 in the near-shoreline area A10 is decreased when the PWC 102 is located in the location alert area including the near-shoreline area A10 within the predetermined distance from the shoreline CL1, and to not issue the predetermined warning when the PWC 102 moves along the target navigation route R. Conventionally, meandering or zigzagging navigation has been considered bad manners in a near-shoreline area within a predetermined distance (within 200 m, for example) from a shoreline. Therefore, when a small marine vessel passes through a near-shoreline area to dock or undock, it has been considered good manners to linearly move away from or toward the shoreline such that the navigation distance of the small marine vessel in the near-shoreline area is as short as possible. However, because route boundaries like roads for automobiles are not present on the sea, it is difficult for a vessel operator to recognize whether or not the small marine vessel is moving along an appropriate route when passing through the near-shoreline area to dock or undock, and thus improvements are required. In order to solve such a problem, the structure described above has been devised. Thus, the target navigation route R is automatically set in the near-shoreline area A10, and the vessel operator U recognizes that the PWC is moving along the target navigation route R due to the absence of the predetermined warning. Therefore, when the PWC passes through the near-shoreline area A10 to dock or undock, the vessel operator U easily recognizes whether or not the PWC is moving along an appropriate route.

According to an example embodiment of the present invention, as described above, the controller 15 is configured or programmed to issue the warning when the PWC 102 deviates from the target navigation route R. Accordingly, the warning is issued when the PWC 102 deviates from the target navigation route R, and thus the vessel operator U is more reliably made aware that the PWC 102 has deviated from the target navigation route R.

According to an example embodiment of the present invention, as described above, the controller 15 is configured or programmed to create the shoreline model CL2 that is smoothed to reduce the irregularities of the shoreline CL1, and to automatically set, in the near-shoreline area A10, the target navigation route R that linearly extends in the direction away from the shoreline model CL2 such that the navigation distance of the PWC 102 in the near-shoreline area A10 is minimized. Accordingly, the possibility that an inaccurate target navigation route R is set, such as that the target navigation route R is set toward a convex portion of the shoreline CL1 having relatively large irregularities when the vessel operator U wants to head toward a concave portion of the shoreline CL1, is reduced or prevented.

According to an example embodiment of the present invention, as described above, the information terminal 101 is operable to transmit the image information and the sound information of the information terminal 101 to the wearable terminal 104 worn by the vessel operator U. Accordingly, the vessel operator U easily checks the image information and the sound information of the information terminal 101 using the wearable terminal 104.

According to an example embodiment of the present invention, as described above, the information terminal 101 includes the display 13 to display the water area map I10 showing the current position P10 of the PWC 102 and the location alert area, is operable to communicate with the cloud server CS operable to hold the map information I3 used to display the water area map I10 on the display 13, and is operable to acquire the map information I3 from the cloud server CS. Accordingly, the map information I3 used to display the water area map I10 on the display 13 of the information terminal 101 is easily acquired from the cloud server CS.

In the methods according to the example embodiments of the present invention, the following advantageous effects are achieved.

According to an example embodiment of the present invention, with the method described above, when external forces including wind and waves act on a hull such that the navigation speed increases, the possibility that the warning is issued that the navigation speed exceeds the speed limit is reduced or prevented, similarly to the structure according to an example embodiment of the present invention described above.

According to an example embodiment of the present invention, as described above, the vessel operator warning support method further includes specifying the engine speed, and disabling the warning includes disabling the warning when the specified engine speed is equal to or lower than the threshold rotation speed. Accordingly, the advantageous effect similar to that of the structure of an example embodiment of the present invention described above is achieved.

According to an example embodiment of the present invention, as described above, the PWC 102 is operable to switch from a state in which the navigation speed is changed by the accelerator to the low rotation speed maintenance mode in which the engine speed is maintained at the predetermined engine speed equal to or lower than the threshold rotation speed, and disabling the warning includes disabling the warning such that the warning is not issued when the PWC 102 switches to the low rotation speed maintenance mode even when the navigation speed exceeds the speed limit. Accordingly, the advantageous effect similar to that of the structure of an example embodiment of the present invention described above is achieved.

According to an example embodiment of the present invention, as described above, the PWC 102 is operable to switch from a state in which the navigation speed is changed by the accelerator to the cruise control mode in which the engine speed is specified by the rotation speed specification operator 63 operable to specify the engine speed by increasing or decreasing the engine speed, and disabling the warning includes disabling the warning such that the warning is not issued when the engine speed is specified to be a value equal to or lower than the threshold rotation speed by the rotation speed specification operator 63 in the cruise control mode even when the navigation speed exceeds the speed limit. Accordingly, the advantageous effect similar to that of the structure of an example embodiment of the present invention described above is achieved.

According to an example embodiment of the present invention, as described above, determining whether or not the navigation speed exceeds the speed limit in the speed restricted area A1 includes acquiring the current position information 12 from the positioning satellite 500 every unit positioning time. Accordingly, the information terminal 101 acquires the current position information 12 from the positioning satellite 500 every unit positioning time, and thus the navigation speed is easily acquired. Thus, the advantageous effect similar to that of the structure of an example embodiment of the present invention described above is achieved.

According to an example embodiment of the present invention, as described above, the vessel operator warning support method further includes disabling the warning such that the warning is not issued regardless of the engine speed when the PWC 102 is in the reverse movement state. Accordingly, the advantageous effect similar to that of the structure of an example embodiment of the present invention described above is achieved.

According to an example embodiment of the present invention, as described above, the information terminal 101 includes the display 13, issuing the warning includes issuing the warning by displaying the warning image on the display 13 when the navigation speed exceeds the speed limit in the speed restricted area A1, and disabling the warning includes disabling the warning such that the warning image is not displayed on the display 13 when the engine speed is equal to or lower than the threshold rotation speed. Accordingly, the advantageous effect similar to that of the structure of an example embodiment of the present invention described above is achieved.

According to an example embodiment of the present invention, as described above, issuing the warning includes issuing the warning by outputting the warning sound from the speaker 103 on the PWC 102 when the navigation speed exceeds the speed limit in the speed restricted area A1, and disabling the warning includes disabling the warning such that the warning sound is not output from the speaker 103 when the engine speed is equal to or lower than the threshold rotation speed. Accordingly, the advantageous effect similar to that of the structure of an example embodiment of the present invention described above is achieved.

According to an example embodiment of the present invention, as described above, issuing the warning includes turning the warning sound down when the first period of time t1 has elapsed from the start of output of the warning sound from the speaker 103. Accordingly, the advantageous effect similar to that of the structure of an example embodiment of the present invention described above is achieved.

According to an example embodiment of the present invention, as described above, turning the warning sound down includes decreasing the warning sound volume to half or less of the volume at the start of output of the warning sound when the first period of time t1 has elapsed from the start of output of the warning sound. Accordingly, the advantageous effect similar to that of the structure of an example embodiment of the present invention described above is achieved.

According to an example embodiment of the present invention, as described above, turning the warning sound down includes gradually decreasing the warning sound volume over the second period of time t2 that is shorter than the first period of time t1 when the first period of time t1 has elapsed from the start of output of the warning sound. Accordingly, the advantageous effect similar to that of the structure of an example embodiment of the present invention described above is achieved.

According to an example embodiment of the present invention, as described above, the location alert area includes the entry prohibited area A2 in which entry of the PWC 102 is prohibited, issuing the warning includes issuing the warning by outputting the warning sound from the speaker 103 not only when the navigation speed exceeds the speed limit in the speed restricted area A1 but also when the PWC 102 enters the entry prohibited area A2, and turning the warning sound down includes decreasing the warning sound volume when the first period of time t1 has elapsed from the start of output of the warning sound that is at the time point at which the PWC 102 enters the entry prohibited area A2. Accordingly, the advantageous effect similar to that of the structure of an example embodiment of the present invention described above is achieved.

According to an example embodiment of the present invention, as described above, the vessel operator warning support method further includes determining whether or not the audio sound volume is equal to or greater than the threshold sound volume when the PWC 102 enters the audio restricted area in which the audio sound volume including music output from the speaker 103 is restricted, and decreasing the audio sound volume and/or notifying the user that the audio sound volume is equal to or greater than the threshold sound volume when the audio sound volume is equal to or greater than the threshold sound volume. Accordingly, the advantageous effect similar to that of the structure of an example embodiment of the present invention described above is achieved.

According to an example embodiment of the present invention, as described above, decreasing the audio sound volume includes decreasing the audio sound volume to the threshold sound volume or less when the audio sound volume is greater than the threshold sound volume when the PWC 102 enters the audio restricted area. Accordingly, the advantageous effect similar to that of the structure of an example embodiment of the present invention described above is achieved.

According to an example embodiment of the present invention, as described above, the vessel operator warning support method further includes acquiring the current position information 12 on the PWC 102 from the positioning satellite 500 every unit positioning time using the information terminal 101, determining whether or not the distance DO between the current position P10 of the PWC 102 indicated by the current position information 12 and the previous position P20 of the PWC 102 indicated by the previous position information 12 is equal to or larger than the threshold distance D1, and correcting the current position P10 to become closer to the previous position P20 and setting the corrected current position P11 when the distance DO between the current position P10 and the previous position P20 is equal to or larger than the threshold distance D1. Accordingly, the advantageous effect similar to that of the structure of an example embodiment of the present invention described above is achieved.

According to an example embodiment of the present invention, as described above, setting the corrected current position P11 includes setting the separation distance D2 from the previous position P20 to the corrected current position P11 based on the navigation speed of the PWC 102 at the previous position P20. Accordingly, the advantageous effect similar to that of the structure of an example embodiment of the present invention described above is achieved.

According to an example embodiment of the present invention, as described above, setting the separation distance D2 includes acquiring the navigation speed used to set the separation distance D2 based on the detection result of the rotation speed detector on the PWC 102 operable to detect the engine speed. Accordingly, the advantageous effect similar to that of the structure of an example embodiment of the present invention described above is achieved.

According to an example embodiment of the present invention, as described above, setting the corrected current position P11 includes setting the corrected current position P11 on the straight line SL connecting the current position P10 to the previous position P20. Accordingly, the advantageous effect similar to that of the structure of an example embodiment of the present invention described above is achieved.

According to an example embodiment of the present invention, as described above, the vessel operator warning support method further includes determining whether or not the PWC 102 is located in the location alert area including the near-shoreline area A10 within the predetermined distance from the shoreline, automatically setting, in the near-shoreline area A10, the target navigation route R that linearly extends in the direction away from the shoreline such that the navigation distance of the PWC 102 in the near-shoreline area A10 is decreased when the PWC 102 is located in the near-shoreline area A10, and not issuing the predetermined warning when the PWC 102 moves along the target navigation route R. Accordingly, the advantageous effect similar to that of the structure of an example embodiment of the present invention described above is achieved.

According to an example embodiment of the present invention, as described above, the vessel operator warning support method further includes issuing the predetermined warning using the information terminal 101 when the PWC 102 deviates from the target navigation route R. Accordingly, the advantageous effect similar to that of the structure of an example embodiment of the present invention described above is achieved.

According to an example embodiment of the present invention, as described above, automatically setting the target navigation route R includes creating the shoreline model CL2 that is smoothed to reduce the irregularities of the shoreline, and automatically setting, in the near-shoreline area A10, the target navigation route R that linearly extends in the direction away from the shoreline model CL2 such that the navigation distance of the PWC 102 in the near-shoreline area A10 is minimized. Accordingly, the advantageous effect similar to that of the structure of an example embodiment of the present invention described above is achieved.

The example embodiments of the present invention described above are illustrative in all points and not restrictive. The extent of the present invention is not defined by the above description of the example embodiments but by the scope of the claims, and all modifications (modified examples) within the meaning and range equivalent to the scope of the claims are further included.

For example, while the example in which the small marine vessel is a PWC has been shown in example embodiments described above, the present invention is not restricted to this. In an example embodiment of the present invention, the small marine vessel may be a jet propulsion boat including a hull that accommodates a vessel operator other than a PWC, for example. Alternatively, the small marine vessel may be an outboard motor boat including an outboard motor, an inboard motor boat including an inboard motor, or an inboard-outboard motor boat including an inboard-outboard motor, for example, instead of a jet propulsion boat including a jet propulsion mechanism.

While the example in which the controller is provided on the information terminal to perform a control to disable the overspeed warning has been shown in example embodiments described above, the present invention is not restricted to this. In an example embodiment of the present invention, the controller may be provided in the ECU of the PWC or on a microcomputer board that is installed on the hull separately from the ECU to perform a control to disable the overspeed warning. The microcomputer board is communicable with the ECU via a wired connection. When the microcomputer board executes a warning application installed on the microcomputer board, predetermined information related to the warning application is displayed on the display of the information terminal or the display of the PWC. When the warning application is installed on the microcomputer board, the vessel operator warning support system may not include the information terminal.

While the example in which the controller is provided in the information terminal to perform a control to decrease the warning sound volume halfway has been shown in example embodiments described above, the present invention is not restricted to this. In an example embodiment of the present invention, the controller may be provided in the ECU of the PWC or on a microcomputer board that is installed on the hull separately from the ECU to perform a control to decrease the warning sound volume halfway. The microcomputer board is communicable with the ECU via a wired connection. When the microcomputer board executes a warning application installed on the microcomputer board, predetermined information related to the warning application is displayed on the display of the information terminal or the display of the PWC. When the warning application is installed on the microcomputer board, the vessel operator warning support system may not include the information terminal.

While the example in which the controller is provided in the information terminal to perform a control to decrease the audio sound volume has been shown in example embodiments described above, the present invention is not restricted to this. In an example embodiment of the present invention, the controller may be provided in the ECU of the PWC or on a microcomputer board that is installed on the hull separately from the ECU to perform a control to decrease the audio sound volume. The microcomputer board is communicable with the ECU via a wired connection. When the microcomputer board executes a warning application installed on the microcomputer board, predetermined information related to the warning application is displayed on the display of the information terminal or the display of the PWC. When the warning application is installed on the microcomputer board, the vessel operator warning support system may not include the information terminal.

While the example in which the controller is provided on the information terminal to perform a control to correct the positional deviation of the PWC has been shown in example embodiments described above, the present invention is not restricted to this. In an example embodiment of the present invention, the controller may be provided in the ECU of the PWC or on a microcomputer board that is installed on the hull separately from the ECU to perform a control to correct the positional deviation of the PWC. The microcomputer board is communicable with the ECU via a wired connection. When the microcomputer board executes a warning application installed on the microcomputer board, predetermined information related to the warning application is displayed on the display of the information terminal or the display of the PWC. When the warning application is installed on the microcomputer board, the vessel operator warning support system may not include the information terminal.

While the example in which the controller is provided on the information terminal to perform a control to automatically set the target navigation route in the near-shoreline area has been shown in example embodiments described above, the present invention is not restricted to this. In an example embodiment of the present invention, the controller may be provided in the ECU of the PWC or on a microcomputer board that is installed on the hull separately from the ECU to perform a control to automatically set the target navigation route in the near-shoreline area. The microcomputer board is communicable with the ECU via a wired connection. When the microcomputer board executes a warning application installed on the microcomputer board, predetermined information related to the warning application is displayed on the display of the information terminal or the display of the PWC. When the warning application is installed on the microcomputer board, the vessel operator warning support system may not include the information terminal.

While the example in which the warning generator of the present invention is an information terminal has been shown in example embodiments described above, the present invention is not restricted to this. In an example embodiment of the present invention, the warning generator may be a microcomputer board that is installed on the hull separately from the ECU. The microcomputer board is communicable with the ECU via a wired connection. When the microcomputer board executes a warning application installed on the microcomputer board, predetermined information related to the warning application is displayed on the display of the information terminal or the display of the PWC. When the warning application is installed on the microcomputer board, the vessel operator warning support system may not include the information terminal.

While the example in which in the control to disable the overspeed warning, a small engine speed is specified using the no-wake mode or cruise control to disable the warning has been shown in example embodiments described above, the present invention is not restricted to this. In an example embodiment of the present invention, the warning may be disabled by operating the throttle lever to decrease the engine speed.

While the example in which in the control to decrease the warning sound volume halfway, the second period of time is shorter than the first period of time has been shown in example embodiments described above, the present invention is not restricted to this. In an example embodiment of the present invention, in the control to decrease the warning sound volume halfway, the second period of time may be longer than the first period of time, or the second period of time may be equal to the first period of time.

While the example in which in the control to decrease the warning sound volume halfway, the second period of time is set, and the warning sound volume is gradually decreased has been shown in example embodiments described above, the present invention is not restricted to this. In an example embodiment of the present invention, in the control to decrease the warning sound volume halfway, the warning sound volume may be decreased without setting the second period of time (the transition time to gradually transition to a lower volume).

While the example in which in the control to decrease the audio sound volume, both the control to decrease the audio sound volume and the control to notify the vessel operator that the audio sound volume is equal to or greater than the threshold sound volume are performed when the audio sound volume is greater than the threshold sound volume when the PWC enters the audio restricted area has been shown in example embodiments described above, the present invention is not restricted to this. In an example embodiment of the present invention, only one of the control to decrease the audio sound volume and the control to notify the vessel operator that the audio sound volume is equal to or greater than the threshold sound volume may be performed. Alternatively, a control may be performed to decrease the audio sound volume when a predetermined period of time has elapsed without the vessel operator decreasing the volume after the vessel operator is notified that the audio sound volume is equal to or greater than the threshold sound volume. In addition, the threshold sound volume may be set in two stages: a first threshold and a second threshold greater than the first threshold, only the above notification may be made when the audio sound volume is greater than the first threshold and equal to or less than the second threshold, and both the above notification and the control to decrease the volume may be performed when the audio sound volume is greater than the second threshold.

While the example in which in the control to correct the positional deviation of the PWC, the separation distance from the previous position to the corrected current position is set based on the navigation speed of the PWC at the previous position has been shown in example embodiments described above, the present invention is not restricted to this. In an example embodiment of the present invention, the separation distance from the previous position to the corrected current position may be set uniformly to a predetermined distance, such as the same distance as the threshold distance, without being based on the navigation speed of the PWC at the previous position.

While the example in which the information terminal acquires the position information from the positioning satellite has been shown in example embodiments described above, the present invention is not restricted to this. In an example embodiment of the present invention, the information terminal may acquire the position information from a base station or the like located on land.

While the example in which the wearable terminal is a head-mounted display has been shown in example embodiments described above, the present invention is not restricted to this. In an example embodiment of the present invention, the wearable terminal may be a headset, for example.

While the process operations performed by the controller are described using flowcharts in a flow-driven manner in which processes are performed in order along a process flow for the convenience of illustration in example embodiments described above, the present invention is not restricted to this. In an example embodiment of the present invention, the process operations performed by the controller may be performed in an event-driven manner in which the processes are performed on an event basis. In this case, the process operations performed by the controller may be performed in a complete event-driven manner or in a combination of an event-driven manner and a flow-driven manner.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel operator warning support system comprising:

a marine vessel including an engine and a communicator;

a warning generator configured or programmed to acquire current position information on the marine vessel and to communicate with the communicator of the marine vessel; and a controller configured or programmed to perform a predetermined control based on an engine speed of the engine; wherein the warning generator is configured or programmed to acquire a navigation speed of the marine vessel based on the position information;

the warning generator is configured or programmed to issue a predetermined warning when the navigation speed exceeds a speed limit in a location alert area including a speed restricted area in which the navigation speed is restricted; and the controller is configured or programmed to perform a control to disable the warning such that the warning is not issued when the engine speed is equal to or lower than a threshold rotation speed even when the navigation speed exceeds the speed limit.

2. The vessel operator warning support system according to claim 1, wherein the threshold rotation speed is set to a value at which the navigation speed is equal to or lower than the speed limit when the engine speed is equal to or lower than the threshold rotation speed in a state in which external forces including wind and waves are not acting.

3. The vessel operator warning support system according to claim 1, wherein the marine vessel is operable to navigate by specifying the engine speed; and the controller is configured or programmed to disable the warning when a specified engine speed is equal to or lower than the threshold rotation speed.

4. The vessel operator warning support system according to claim 3, wherein the marine vessel is operable to switch from a state in which the navigation speed is changed by an accelerator to a low rotation speed maintenance mode in which the engine speed is maintained at a predetermined engine speed equal to or lower than the threshold rotation speed; and the controller is configured or programmed to disable the warning such that the warning is not issued when the marine vessel switches to the low rotation speed maintenance mode even when the navigation speed exceeds the speed limit.

5. The vessel operator warning support system according to claim 3, wherein the marine vessel includes a rotation speed specification operator to specify the engine speed by increasing or decreasing the engine speed, and is operable to switch from a state in which the navigation speed is changed by an accelerator to a cruise control mode in which the engine speed is specified by the rotation speed specification operator; and the controller is configured or programmed to disable the warning such that the warning is not issued when the engine speed is specified to be a value equal to or lower than the threshold rotation speed by the rotation speed specification operator in the cruise control mode even when the navigation speed exceeds the speed limit.

6. The vessel operator warning support system according to claim 1, wherein the warning generator is configured or programmed to acquire the current position information from a positioning satellite.

7. The vessel operator warning support system according to claim 1, wherein the controller is configured or programmed to disable the warning such that the warning is not issued regardless of the engine speed when the marine vessel is in a reverse movement state.

8. The vessel operator warning support system according to claim 1, wherein the warning generator includes a display, and is configured or programmed to, when the navigation speed exceeds the speed limit in the speed restricted area, issue the warning by displaying a warning image on the display; and the controller is configured or programmed to disable the warning such that the warning image is not displayed on the display when the engine speed is equal to or lower than the threshold rotation speed.

9. The vessel operator warning support system according to claim 1, further comprising:

a speaker on the marine vessel to output a warning sound as the warning; wherein the warning generator is configured or programmed to issue the warning by outputting the warning sound from the speaker when the navigation speed exceeds the speed limit in the speed restricted area; and the controller is configured or programmed to disable the warning such that the warning sound is not output from the speaker when the engine speed is equal to or lower than the threshold rotation speed.

10. The vessel operator warning support system according to claim 9, wherein the controller is configured or programmed to perform a control to decrease a warning sound volume when a first period of time has elapsed from a start of output of the warning sound.

11. The vessel operator warning support system according to claim 10, wherein the controller is configured or programmed to decrease the warning sound volume to half or less of a volume at the start of output of the warning sound when the first period of time has elapsed from the start of output of the warning sound.

12. The vessel operator warning support system according to claim 10, wherein the controller is configured or programmed to gradually decrease the warning sound volume over a second period of time that is shorter than the first period of time when the first period of time has elapsed from the start of output of the warning sound.

13. The vessel operator warning support system according to claim 10, wherein the location alert area includes an entry prohibited area in which entry of the marine vessel is prohibited;

the warning generator is configured or programmed to issue the warning by outputting the warning sound from the speaker not only when the navigation speed exceeds the speed limit in the speed restricted area but also when the marine vessel enters the entry prohibited area; and the controller is configured or programmed to decrease the warning sound volume when the first period of time has elapsed from the start of output of the warning sound that is at a time point at which the marine vessel enters the entry prohibited area.

14. The vessel operator warning support system according to claim 1, further comprising:

a speaker on the marine vessel to output a warning sound as the warning and an audio sound including music; wherein the controller is configured or programmed to perform at least one of a control to decrease an audio sound volume or a control to notify a vessel operator that the audio sound volume is greater than a threshold sound volume when the audio sound volume is greater than the threshold sound volume when the marine vessel enters an audio restricted area in which the audio sound volume is restricted.

15. The vessel operator warning support system according to claim 14, wherein the controller is configured or programmed to decrease the audio sound volume to the threshold sound volume or less when the audio sound volume is greater than the threshold sound volume when the marine vessel enters the audio restricted area.

16. The vessel operator warning support system according to claim 1, wherein the warning generator is configured or programmed to acquire the current position information from a positioning satellite; and the controller is configured or programmed to perform a control to correct a current position of the marine vessel indicated by the current position information to become closer to a previous position of the marine vessel indicated by previous position information, and set a corrected current position when a distance between the current position and the previous position is equal to or greater than a threshold distance.

17. The vessel operator warning support system according to claim 16, wherein the controller is configured or programmed to set a separation distance from the previous position to the corrected current position based on the navigation speed of the marine vessel at the previous position.

18. The vessel operator warning support system according to claim 17, wherein the marine vessel includes a rotation speed detector to detect the engine speed; and the controller is configured or programmed to acquire the navigation speed used to set the separation distance based on a detection result of the rotation speed detector.

19. The vessel operator warning support system according to claim 16, wherein the controller is configured or programmed to set the corrected current position on a straight line connecting the current position to the previous position.

20. The vessel operator warning support system according to claim 1, wherein the controller is configured or programmed to automatically set, in a near-shoreline area within a predetermined distance from a shoreline, a target navigation route that linearly extends in a direction away from the shoreline such that a navigation distance of the marine vessel in the near-shoreline area is decreased when the marine vessel is located in the location alert area including the near-shoreline area, and to not issue the predetermined warning when the marine vessel moves along the target navigation route.

21. The vessel operator warning support system according to claim 20, wherein the controller is configured or programmed to issue the warning when the marine vessel deviates from the target navigation route.

22. The vessel operator warning support system according to claim 20, wherein the controller is configured or programmed to create a shoreline model that is smoothed to reduce irregularities of the shoreline, and to automatically set, in the near-shoreline area, the target navigation route that linearly extends in a direction away from the shoreline model such that the navigation distance of the marine vessel in the near-shoreline area is minimized.

23. The vessel operator warning support system according to claim 1, wherein the warning generator is configured or programmed to transmit image information and sound information of the warning generator to a wearable terminal worn by a vessel operator.

24. The vessel operator warning support system according to claim 1, wherein the warning generator includes a display to display a water area map showing a current position of the marine vessel and the location alert area, and is configured or programmed to communicate with a cloud server operable to hold map information used to display the water area map on the display, and to acquire the map information from the cloud server.

25. A vessel operator warning support method comprising:

acquiring a navigation speed of a marine vessel based on current position information and determining whether or not the navigation speed exceeds a speed limit in a location alert area including a speed restricted area in which the navigation speed is restricted using a warning generator;

issuing a predetermined warning when the navigation speed exceeds the speed limit in the speed restricted area using the warning generator;

determining whether or not an engine speed is equal to or lower than a threshold rotation speed; and disabling the warning such that the warning is not issued when the engine speed is equal to or lower than the threshold rotation speed even when the navigation speed exceeds the speed limit.

26. The vessel operator warning support method according to claim 25, wherein the issuing of the warning includes issuing the warning by outputting a warning sound from a speaker on the marine vessel when the navigation speed exceeds the speed limit in the speed restricted area; and the disabling of the warning includes disabling the warning such that the warning sound is not output from the speaker when the engine speed is equal to or lower than the threshold rotation speed.

27. The vessel operator warning support method according to claim 26, wherein the issuing of the warning includes turning the warning sound down when a first period of time has elapsed from a start of output of the warning sound from the speaker.

28. The vessel operator warning support method according to claim 25, further comprising:

determining whether or not an audio sound volume is equal to or greater than a threshold sound volume when the marine vessel enters an audio restricted area in which the audio sound volume including music output from a speaker is restricted; and decreasing the audio sound volume and/or notifying a user that the audio sound volume is equal to or greater than the threshold sound volume when the audio sound volume is equal to or greater than the threshold sound volume.

29. The vessel operator warning support method according to claim 25, further comprising:

acquiring the current position information on the marine vessel from a positioning satellite using the warning generator;

determining whether or not a distance between a current position of the marine vessel indicated by the current position information and a previous position of the marine vessel indicated by previous position information is equal to or larger than a threshold distance; and correcting the current position to become closer to the previous position and setting a corrected current position when the distance between the current position and the previous position is equal to or larger than the threshold distance.

30. The vessel operator warning support method according to claim 25, further comprising:

determining whether or not the marine vessel is located in the location alert area including a near-shoreline area within a predetermined distance from a shoreline;

automatically setting, in the near-shoreline area, a target navigation route that linearly extends in a direction away from the shoreline such that a navigation distance of the marine vessel in the near-shoreline area is decreased when the marine vessel is located in the near-shoreline area; and not issuing the predetermined warning when the marine vessel moves along the target navigation route.

* * * * *